US012698596B2

(12) United States Patent
Chang et al.

(10) Patent No.: US 12,698,596 B2
(45) Date of Patent: Aug. 4, 2026

(54) METHOD, APPARATUS, AND SYSTEM OF A FIBRILLATED NANOCELLULOSE MATERIAL

(71) Applicants: Yiu Wen Chang, Hong (CN); George Dah Ren Chen, Hong Kong (CN)

(72) Inventors: Yiu Wen Chang, Hong (CN); George Dah Ren Chen, Hong Kong (CN)

(73) Assignee: ECOINNO (H.K.) LIMITED, Hong Kong (CN)

( * ) Notice: Subject to any disclaimer, the term of this patent is extended or adjusted under 35 U.S.C. 154(b) by 544 days.

(21) Appl. No.: 17/923,571

(22) PCT Filed: May 4, 2021

(86) PCT No.: PCT/IB2021/053711
§ 371 (c)(1),
(2) Date: Nov. 4, 2022

(87) PCT Pub. No.: WO2021/224778
PCT Pub. Date: Nov. 11, 2021

(65) Prior Publication Data

US 2023/0183924 A1 Jun. 15, 2023

Related U.S. Application Data

(63) Continuation-in-part of application No. 17/241,050, filed on Apr. 26, 2021, now abandoned.
(Continued)

(51) Int. Cl.
*D21H 23/20* (2006.01)
*D21F 13/02* (2006.01)
(Continued)

(52) U.S. Cl.
CPC ..... *D21H 23/20* (2013.01); *D21F 13/02* (2013.01); *D21F 13/10* (2013.01); *D21H 11/18* (2013.01);
(Continued)

(58) Field of Classification Search
None
See application file for complete search history.

(56) References Cited

U.S. PATENT DOCUMENTS

2019/0062998 A1* 2/2019 Chen ..... D21H 17/59
2019/0194870 A1* 6/2019 Kuo ..... D21H 19/82

FOREIGN PATENT DOCUMENTS

CN 1192496 A 9/1998
CN 102869832 A 1/2013
(Continued)

OTHER PUBLICATIONS

Smook, Handbook for Pulp and Paper Technologists, 1992, Angus Wilde Publications, 2nd edition, chapter 16. (Year: 1992).*
(Continued)

*Primary Examiner* — Anthony Calandra
(74) *Attorney, Agent, or Firm* — Loeb & Loeb LLP

(57) ABSTRACT

Embodiments of the invention overcome the shortcomings of prior technologies by infusing nanocellulose in a fibrillated form to enhance the properties of cellulose pulp. These properties may include, for example, the mechanical and barrier properties, i.e., tensile strength, liquid, and gas impermeability such as oxygen, carbon dioxide, and oil, may be improved substantially. Another embodiment of the invention further provide a fibrillated cellulose composite material that include properties of being a strength-enhancing agent, an oligomer, carboxylic acid, plasticizer, an antimicrobial agent, water repellant, and/or a transparent composite.

16 Claims, 19 Drawing Sheets

Related U.S. Application Data

(60) Provisional application No. 63/019,849, filed on May 4, 2020, provisional application No. 63/019,852, filed on May 4, 2020.

(51) Int. Cl.

| | |
|---|---|
| ***D21F 13/10*** | (2006.01) |
| ***D21H 11/18*** | (2006.01) |
| ***D21H 21/16*** | (2006.01) |
| ***D21H 21/20*** | (2006.01) |
| ***D21J 3/00*** | (2006.01) |

(52) U.S. Cl.
CPC ..... *D21H 21/16* (2013.01); *D21H 21/20* (2013.01); *D21J 3/00* (2013.01)

(56) References Cited

FOREIGN PATENT DOCUMENTS

| | | | | | |
|---|---|---|---|---|---|
| CN | 103966888 | | | 8/2014 | |
| CN | 109152394 | | | 1/2019 | |
| CN | 109152394 | A | | 1/2019 | |
| CN | 110777568 | | | 2/2020 | |
| EP | 3508637 | | | 7/2019 | |
| JP | 2016132241 | | | 7/2016 | |
| JP | 2018-199872 | | | 12/2018 | |
| KR | 20060018983 | A | * | 3/2006 | ..... D21J 5/00 |
| KR | 100783194 | B1 | * | 12/2007 | ..... D21J 3/00 |
| TW | 201908344 | A | | 3/2019 | |
| TW | 202131900 | A | | 9/2021 | |
| WO | 2012071578 | A2 | | 5/2012 | |
| WO | 2019166929 | | | 9/2019 | |
| WO | WO-2020227409 | A1 | * | 11/2020 | ..... B29C 43/56 |
| WO | 2021224778 | | | 11/2021 | |

OTHER PUBLICATIONS

Smook, Handbook for Pulp and Paper Technologists, 1992, Angus Wilde Publications, 2nd edition, chapters 9,13, 16, 18, and19. (Year: 1992).*

English Machine translation KR100783194B1, 2007. (Year: 2007).*

English machine translation KR20040067393, 2006. (Year: 2006).*

International Search Authority, "International Search Report," issued in connection to International Application No. PCT/IB2021/053711, mailed on Aug. 21, 2021, 2 pages.

Taiwanese Office Action issued in App. No. TW110116100, dated Apr. 29, 2022, 16 pages.

Japanese Office Action (including English translation) issued in App. No. JP2022567607, dated May 27, 2025, 1-5 pages.

Chinese Office Action (including English translation) issued in App. No. CN202110491294, dated Feb. 28, 2024, 28 pages.

* cited by examiner

METHOD, APPARATUS, AND SYSTEM OF A FIBRILLATED NANOCELLULOSE MATERIAL

CROSS-REFERENCE TO RELATED APPLICATIONS

This application is a US national phase of PCT application PCT/IB2021/053711, filed on May 4, 2021, which claims priority to U.S. provisional applications 63/019,852 and 63/019,849, both filed on May 4, 2020 and U.S. nonprovisional application Ser. No. 17/241,050, filed on Apr. 26, 2021; all of which are incorporated by reference in their entirety herein.

TECHNICAL FIELD

Aspects of the invention generally relate to renewal and recyclable material. More particularly, embodiments of the invention relate to fibrillated cellulose materials made for consumer products.

BACKGROUND

Increasing concerns over the environmental crisis—plastic waste pollution—has triggered extensive investigations into sustainable and renewable materials. In the effort to circumvent petroleum derivative polymers, a naturally occurring biopolymer, plant-based—cellulose fibers offers alternatives to the material research community. Cellulose fibers are gaining their attention due to the ubiquitous source, sustainable, renewable, and more importantly, it affords the end product with 100% biodegradability in nature.

However, many existing biodegradable products based on cellulose fibers fail to live up to the expectation. For example, the cost of producing these cellulose fibrous products is not economically conducive for mass production. In addition, due to the need for water resistance, oil resistance or non-stick property, many of the cellulose fibrous products rely heavily on synthetic chemical compositions to achieve these properties or effects. For example, many existing products require a coat of fluorocarbon to be applied on the surface that come in contact with food or beverage items. Moreover, some of these fluorocarbon-based chemicals, such as perfluorooctanoic acid (PFOA or C8), may cause long-term negative health and environmental effects.

In addition, current practices do not create two layers or layers of fibrillated cellulose materials. Rather, prior practices merely attempt to produce one layer from a cellulose pulp solution.

SUMMARY

Embodiments of the invention overcome the shortcomings of prior technologies by infusing nanocellulose in a fibrillated form to enhance the properties of cellulose pulp. These properties may include, for example, the mechanical and barrier properties, i.e., tensile strength, liquid, and gas impermeability such as oxygen, carbon dioxide, and oil, may be improved substantially.

Another embodiment of the invention further provide a fibrillated cellulose composite material that include layers or mixtures of fibrillated cellulose to create properties of being a strength-enhancing agent, an oligomer, carboxylic acid, plasticizer, an antimicrobial agent, water repellant, and/or a transparent composite. The composite material further may be generally free from chemical additives to enhance the above properties. In yet another embodiment, the composite material may further include a base substrate such as pulp and another layer such as fibrillated cellulose. In another amendment, aspects of the invention provide a method for generating a biodegradable material that comprises the following steps: receiving a first material at a fiber catcher for catching a portion of fibers in the first material; engaging a second material; engaging the second material in a vacuum state to form a third material; and reducing water content in the third material.

BRIEF DESCRIPTION OF DRAWINGS

Persons of ordinary skill in the art may appreciate that elements in the figures are illustrated for simplicity and clarity so not all connections and options have been shown. For example, common but well-understood elements that are useful or necessary in a commercially feasible embodiment may often not be depicted in order to facilitate a less obstructed view of these various embodiments of the present disclosure. It may be further appreciated that certain actions and/or steps may be described or depicted in a particular order of occurrence while those skilled in the art may understand that such specificity with respect to sequence is not actually required. It may also be understood that the terms and expressions used herein may be defined with respect to their corresponding respective areas of inquiry and study except where specific meanings have otherwise been set forth herein.

FIGS. 14A to 14D illustrate exemplary end products produced by aspects of the embodiments.

DETAILED DESCRIPTION

Figure 1:
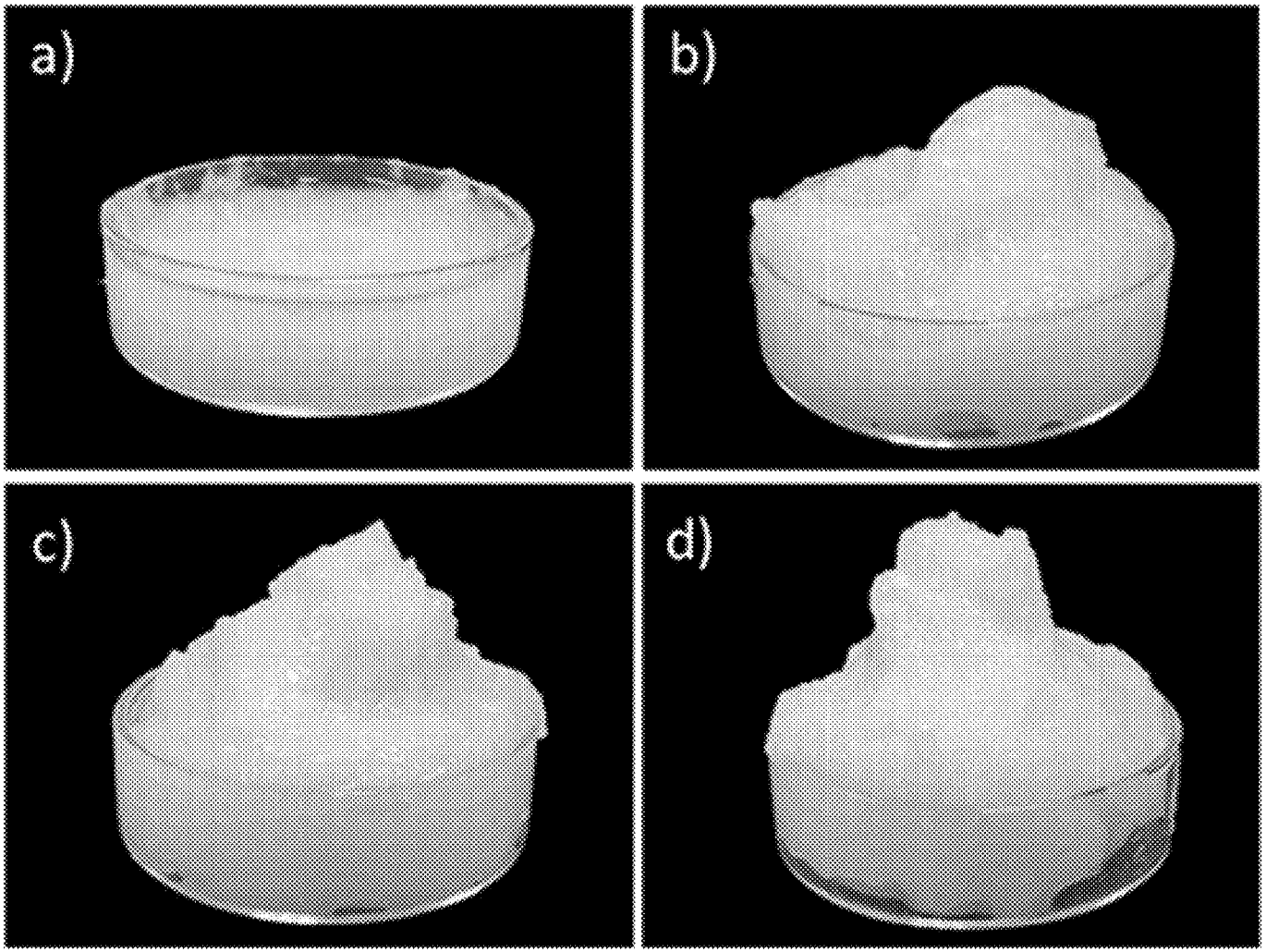
FIGS. 1A through 1D illustrate a material of the cellulose fibers aqueous suspension according to one embodiment.

Embodiments may now be described more fully with reference to the accompanying drawings, which form a part hereof, and which show, by way of illustration, specific exemplary embodiments which may be practiced. These illustrations and exemplary embodiments may be presented with the understanding that the present disclosure is an exemplification of the principles of one or more embodiments and may not be intended to limit any one of the embodiments illustrated. Embodiments may be embodied in many different forms and should not be construed as limited to the embodiments set forth herein; rather, these embodiments are provided so that this disclosure may be thorough and complete, and may fully convey the scope of embodiments to those skilled in the art. The following detailed description may, therefore, not to be taken in a limiting sense.

Embodiments of the invention include a material, such as a Green Composite Material™ (GCM™), that may comprise fibrillated cellulose as a core material without any material. In one embodiment, the composite material may include pulp and fibrillated cellulose. In another embodiment, the composite material may be generally free from chemical additives or agents. In yet another embodiment, the composite material may be independently derived plant fibers. In one embodiment, the chemical additives or agents may be naturally based or non-toxic. In another embodiment, the chemical additives or agents may be created by laboratories. In some embodiments, these plant fibers may be derived from bagasse, bamboo, abaca, sisal, hemp, flax, hop, jute, kenaf, palm, coir, corn, cotton, wood, and any combination thereof. In yet other embodiments, the plant fibers may be pre-processed or semi-processed cellulose. In other embodiments, a green composite material with fibrillated cellulose may be obtained by processing plant fibers through a refining process, such as a high-pressure homogenizer or refiner. In further embodiments, a composite material with fibrillated cellulose obtained via bacterial strains (without the cellulose producing microorganism). In alternative embodiments, a material with fibrillated cellulose may be obtained from a marine source.

In one embodiment, the shape and size of the cellulose may depend on the source of origin of the fiber or a combination of fibers and the process of making it. Nonetheless, fibrillated cellulose generally has a diameter and a length, as described below. The fibrillated cellulose, in one embodiment, may have a diameter of about 1-5000 nanometer (nm). In yet another embodiment, the fibrillated cellulose may have a diameter of about 5-150 nm or from about 100-1000 nm. In yet another embodiment, the fibrillated cellulose may have a diameter of about 5000-10000 nm.

In yet a further embodiment, the material may have enhanced properties that heighten, enhance, or improve various properties without toxic chemical additives or agents. In another embodiment, the material having various properties that are suitable to carry food or liquid items that is generally free from chemical additives or agents. For example, as shown in prior art, various toxic chemical additives or agents have added to materials during manufacturing process or coated thereon that provide a desirable tensile strength, either dry or wet, enhanced oil barrier, gas and/or liquid impermeability. Aspects of the invention, instead of with the various toxic chemical additives or agents added to the material, include a composite material with the fibrillated cellulose that is generally free from these additives or agents.

For example, the fibrillated cellulose may have a length of about 0.1-1000 micrometers, about 10-500 micrometers, about 1-25 micrometers, or about 0.2-100 micrometers. In some embodiments, a material with fibrillated cellulose of different diameters, such as with a weight ratio of 1:100. In another embodiment, the fibrillated cellulose may be with a weight ratio of 1:1. In a further embodiment, the material with mixed fibrillated cellulose may afford the advantages such as improved tensile strength, either dry or wet, enhanced oil barrier, gas and/or liquid impermeability, and cost savings.

In some embodiments, a material with fibrillated cellulose may possess a property of an oxygen transmission rate of about 8000 $cm^3$ $m^{-2}24$ $h^{-1}$ or less. In another embodiment, the oxygen transmission rate of about 5000 $cm^3$ $m^{-2}$ 24 $h^{-1}$ or less. In yet another embodiment, the oxygen transmission rate of about 1000 $cm^3$ $m^{-2}$ 24 $h^{-1}$ or less.

Furthermore, in yet some embodiment, the material may possess a property of a water vapor transmission rate of about 3000 g $m^{-2}$ 24 $h^{-1}$ or less. Moreover, for another embodiment, the water vapor transmission rate may be about 1500 g $m^{-2}$ 24 $h^{-1}$ or less.

In some embodiments, a material may possess a property of a dry tensile strength of about 30 MPa or higher. In another embodiment, the dry tensile strength may be about 70 MPa. In yet another embodiment, the dry tensile strength may be about 100 MPa or higher. In some embodiments, the material may possess a property of a dry tensile modulus of about 4 GPa or higher. In another embodiment, the dry tensile modulus of about 6 GPa or higher.

In some embodiments, the material may possess a property of a dry tensile index of about 45 Nm $g^{-1}$ or higher. In another embodiment, the property may be about 80 Nm $g^{-1}$ or higher.

In some embodiments, the material may possess a property of a wet tensile strength of about 5 MPa or higher. In another embodiment, the wet tensile strength may be about 20 MPa or higher.

In some embodiments, the material may possess a property of a wet tensile modulus of about 0.4 MPa or higher. In another embodiment, the wet tensile modulus may be about 1.0 MPa or higher.

In some embodiments, the material may possess a property of a wet tensile index of about 5 Nm $g^{-1}$ or higher. In another embodiment, the wet tensile index may be about 20 Nm $g^{-1}$ or higher.

In an alternative embodiment, the material may include an adhesive agent to enhance dry and/or wet strength. In one embodiment, the adhesive agent may include polymers. In other embodiments, the adhesive agent may include metal salts. In another embodiment, the adhesive agent may include oligomers. In yet other embodiment, the adhesive agent may include a carboxylic acid. In yet an alternative embodiment, the adhesive agent may include a plasticizer. In some embodiments, the weight ratio of fibrillated cellulose to the adhesive agent in the present invention may be about 33:1 to 1:1.

For example, the polymers may include polyester, gelatin, polylactic acid, chitin, sodium alginate, thermoplastic starch, polyethylene, chitosan, chitin glucan, polyvinyl alcohol, or polypropylene. In one embodiment, the polymers may include in chemical additives that may be applied to the composite materials of aspects of the invention. For example, the chemical additives may be embedded in the material itself or may be sprayed or coated thereon.

In yet another embodiments, the adhesive agent may include metal salts. For example, the metal salts may include potassium zirconium carbonate, potassium aluminum sulphate, calcium carbonate, and calcium phosphate. In some embodiments, the weight ratio of fibrillated cellulose to the adhesive agent in the present invention may be about 33:1 to 1:1.

In another embodiment, the adhesive agent may include oligomers. In one example, the oligomers may include oligonucleotide, oligopeptide, and polyethylene glycol. In some embodiments, the weight ratio of fibrillated cellulose to the adhesive agent in the present invention may be about 33:1 to 1:1.

In yet other embodiment, the adhesive agent may include a carboxylic acid. For example, the carboxylic acid may include citric acid, adipic acid, and glutaric acid. In some embodiments, the weight ratio of fibrillated cellulose to the adhesive agent in the present invention may be about 33:1 to 1:1.

In embodiment, the adhesive agent with the plasticizer may reduce a brittleness and gas permeability of the adhered composite. In some embodiments, the plasticizer may include polyol. In one embodiment, the polyol may comprise glycerol. In one embodiment, the polyol may comprise sorbitol. In one embodiment, the polyol may comprise pentaerythritol. In some embodiments, the polyol may comprise polyethylene glycol. In some embodiments, the weight ratio of plasticizer to the composite material to an adhesive agent is about 5:33:1 to about 1:1:1.

In another embodiment, the plasticizer may comprise branched polysaccharide, wax, fatty acid, fat and oil.

Aspects of the invention may further include a water repellent agent as a chemical additive to repel gas and/or liquid state water. In some embodiments, the water repellent agent comprises an animal-based wax, an animal-based oil or an animal-based fat. In one embodiments, the water repellent agent comprises a petroleum-derived wax or a petroleum-based wax. In other embodiments, the water repellent agent comprises a plant-based wax, a plant-based oil or a plant-based fat.

In some embodiments, an animal-based water repellent may comprise beeswax, shellac and whale oil.

In some embodiments, a petroleum-based wax water repellent may comprise paraffin wax, paraffin oil and mineral oil.

In some embodiments, a plant-based water repellent may comprise carnauba wax, soy oil, palm oil, palm wax, carnauba wax and coconut oil.

In some embodiments, a water repelling agent may comprise adhesive agent such as potassium zirconium carbonate, potassium aluminum sulphate, calcium carbonate and calcium phosphate.

In a further embodiment, the material may comprise fibrillated cellulose further optionally may include an antimicrobial agent. In some embodiments, an antimicrobial agent may comprise tea polyphenol. In some embodiments, an antimicrobial agent may comprise pyrithione salts, parabens, paraben salts, quaternary ammonium salts, imidazolium, benzoic acid sorbic acid and potassium sorbate.

Moreover, another embodiment of the invention may include a material having fibrillated cellulose further optionally comprises a transparent composite to increase the transmission of light with wavelength from about 300 to 800 nm. In some embodiments, a material may comprise branched polysaccharides. In some embodiments, the weight ratio of the material to transparent composite ranges differently, which may depend on the transparency required, e.g., about 99:1 to about 1:99.

In some embodiments, branched polysaccharides may comprise starch, dextran, xantham gum, and galactomannan.

In some embodiments, a dextran may comprise agarose, pullulan, and curdan.

In some aspects, provided herein is the manufacture of products made by the material disclosed herein, and readily forms into designated shape, e.g., either 2 dimensional or 3-dimensional. For example, the two-dimensional example may be a planar sheet where the planar sheet may be used to be decomposed for forming end products. In another example, the material may be in a solution that may be ready for forming end products. In yet another embodiment, the three-dimensional example may be end products.

Figure 5:
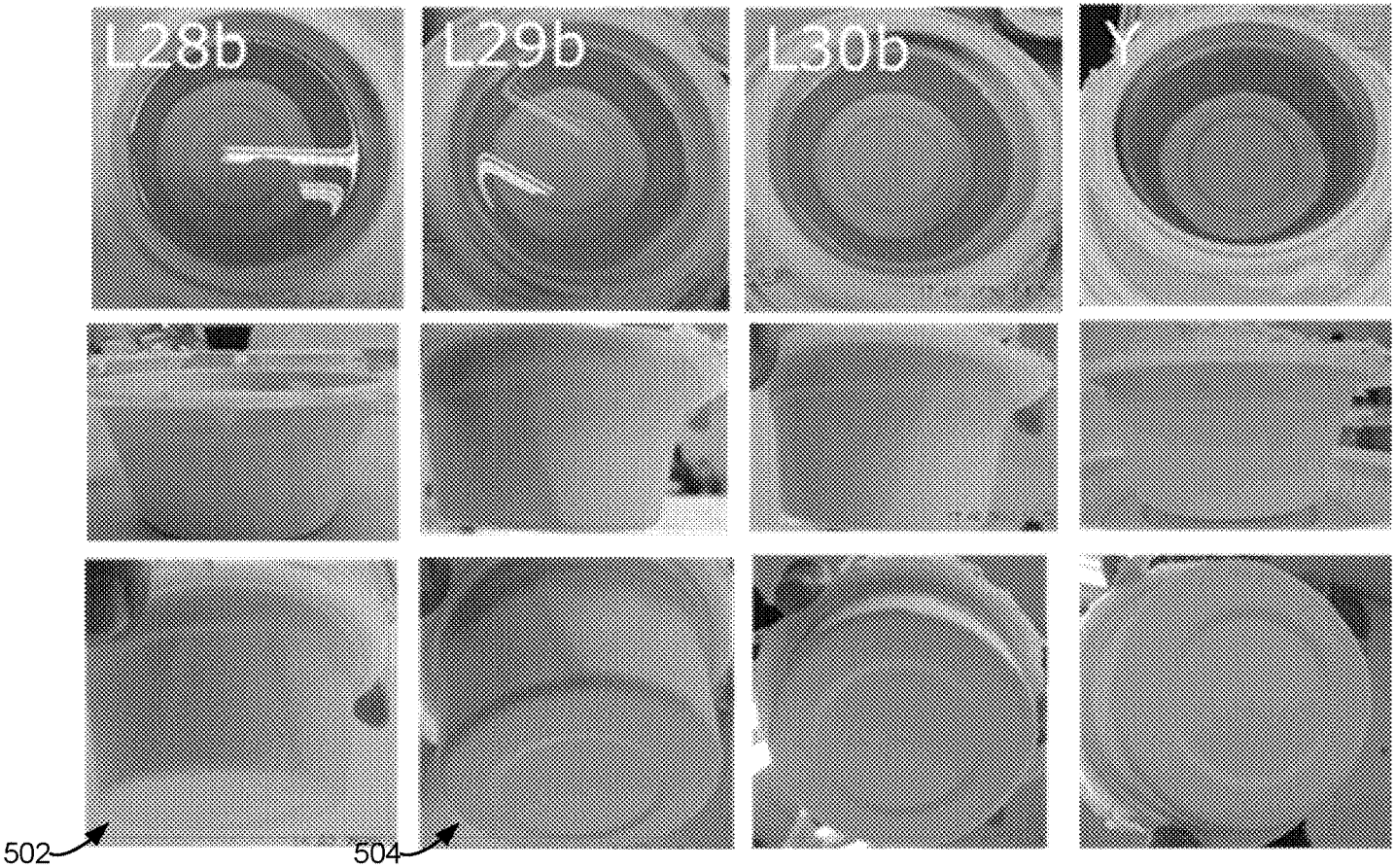
FIG. 5 illustrates images of containers made of fibrillated cellulose L28b, L29b, L30b, and Y were able to hold oil for 10 days according to one embodiment.
Figure 6A:
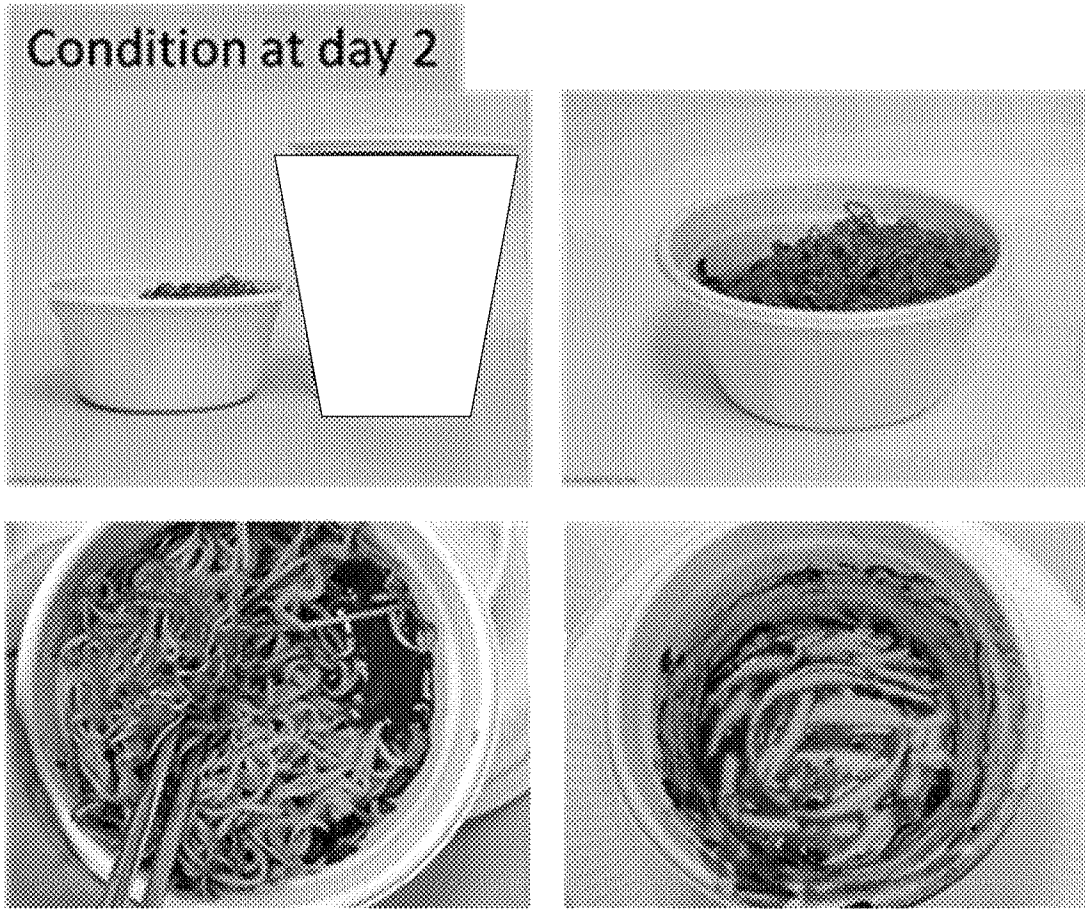
FIG. 6A are images showing food items with boiling water in a material for about 5 minutes according to one embodiment.
Figure 6B:
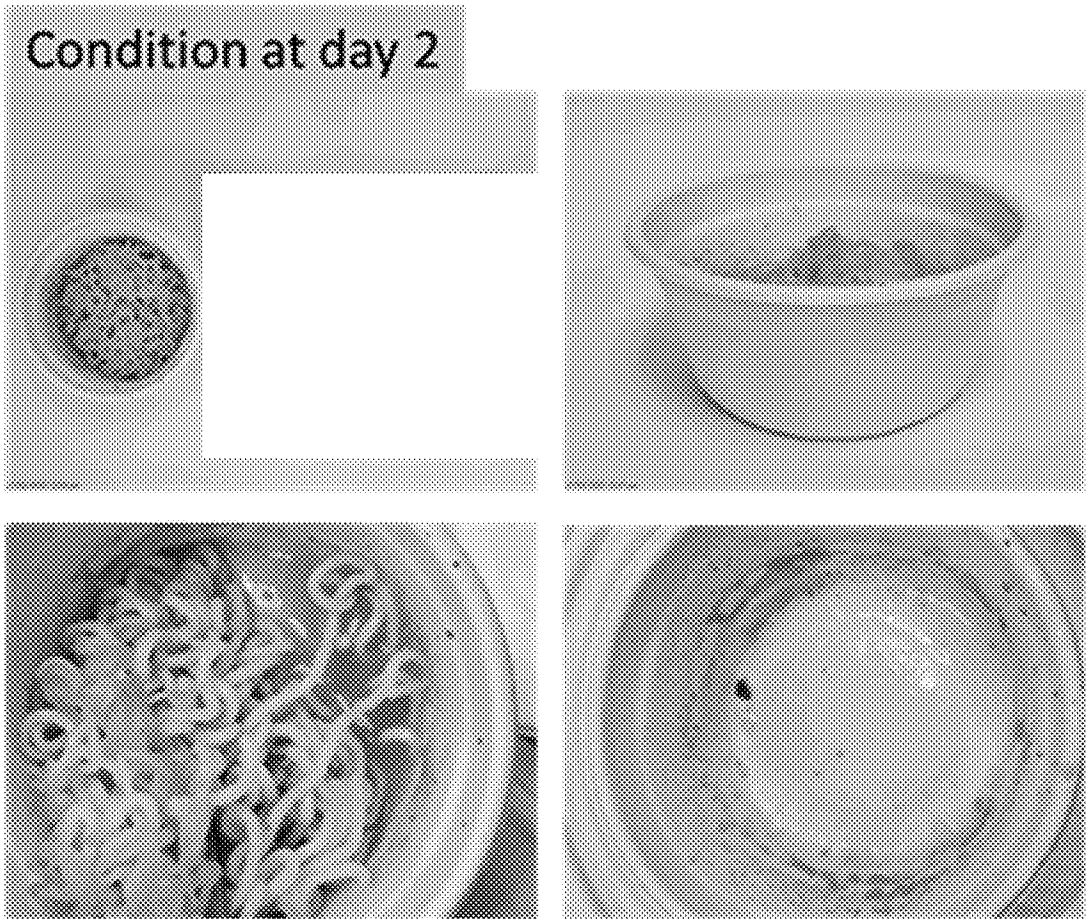
FIG. 6B are images showing food items with boiling water and under microwave being heated at 800 W for 2 minutes according to one embodiment.
Figure 7:
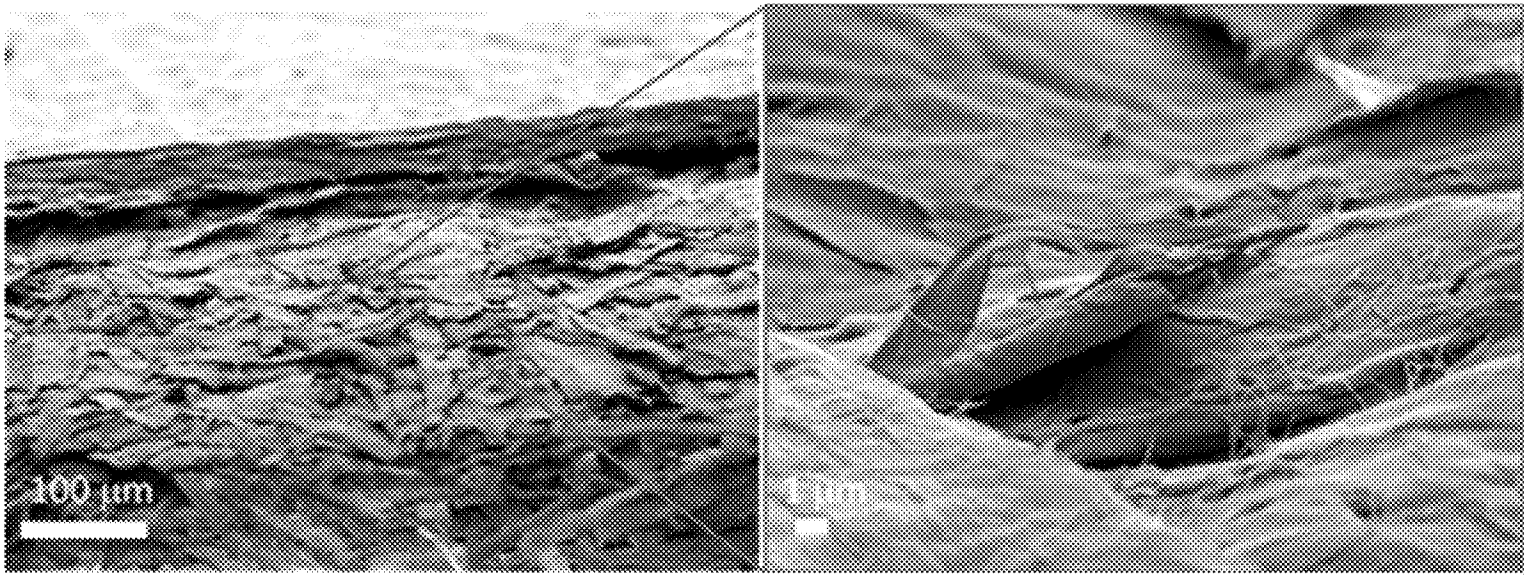
FIG. 7 is another SEM image of a material for a structure of fibrillated cellulose used in food container according to one embodiment.

In one aspect, in some embodiments, the end product may include containers for digestible or edible items, such as those shown in FIG. 5 to FIG. 7. For example, the end products that embody the materials as described in this application may include food containers or packages. Using it as an example and not as a limitation, the food containers or packages may include airplane or airline meal containers, disposable cups, ready-to-eat food containers, capsules, ice cream carton or containers, and chocolate containers. In some embodiments, a product may comprise instant food containers that may further contain spices, e.g., instant cup noodles, instant soup, or the like. Other containers may include housing or casing for electrical cigarette, or the like. In such example, for a consumer to digest or consume the digestible or edible items contained in the container embodying aspects of the invention, the container may be subjected to water or liquid at high temperature, such as about 100 degrees Celsius.

In another embodiment, for products that may be used one an airplane meal and beverage containers. Currently, the airplane meal containers are made of various forms of plastic for properties of lightweight, rigidity, oil resistance, etc. In addition, existing plastic containers may be subjected to heating via an oven. The heating may release carcinogenic substance from the plastic container to the digestible or edible items. As such, such effects are not desirable. Embodiments of the invention, along with the properties described above, may exhibit properties that are water resistant, high heat tolerance, oil resistant, etc., without releasing carcinogenic substance.

In another embodiment, the capsule example may be a capsule for machines for hot beverage. For example, the capsule may be contain coffee, tea, herbs, or other drinks. For example, the capsule may be a disposable capsule. In another example, the capsule may be a disposable coffee bag or pouch. In such an example, the electrical beverage machine may deposit or inject water at high temperature or high pressure to the capsule so that the beverage making process may start and that the coffee may drip out of the capsule or pouch to a consumer's cup. As the capsule or pouch comprises the biodegradable and sustainable materials having one or more properties as described above, the capsule or pouch may be easily recycled without creating burden to the environment.

In one embodiment, the capsule may have a sidewall with a thickness of about 500 micron. In one embodiment, the capsule may include a top or a lid having a thickness of about 500 micron. In yet another embodiment, the capsule may include a bottom thickness of about 300 micron. In yet a further embodiment, the capsule may be formed/created in one pass from the former (to be discussed below) and that the thickness of a top, a sidewall and a bottom with different thickness.

In some embodiments, a product may include a filter to separate, whether permanently, semi-impermeable, or lightly impermeable to particles or molecules in fluid. For example, the product may include a face mask or filter membrane with solid-liquid separation, liquid-liquid separation, or gas-liquid separation effects, etc.

In some embodiments, a product may comprise cosmetic or skincare container products, medical products, e.g., powder case, palette, protective glass, or medical-grade disposals. In some embodiments, a product may comprise part of medical device, automobile, electronic device, and construction material (as reinforcement material).

Overall, in one embodiment, containers embodying materials of the invention may be in a form of containers, planar sheets, trays, plates, reels, boards, or films. In such an embodiment, a width or length of the material may range from about 0.01 mm to 10000 mm or above. In one embodiment, the width or length may range from about 0.01 mm-1000 mm. In the embodiment, the films may be a thin-layered film with a thickness of about 0.01-3.0 mm. In one embodiment, the thickness may be about 0.02-0.20 mm. In yet other embodiments, the product may comprise a food package containing oil to water weight ratio of about 100:1 to about 1:100.

In another embodiment, aspects of the invention may provide a process of manufacturing, generating, or creating the material comprising fibrillated cellulose having properties of the above.

Example 1

In addition to the material provided above, aspects of the invention may include a cellulose fibrillation process or method.

Figure 8:
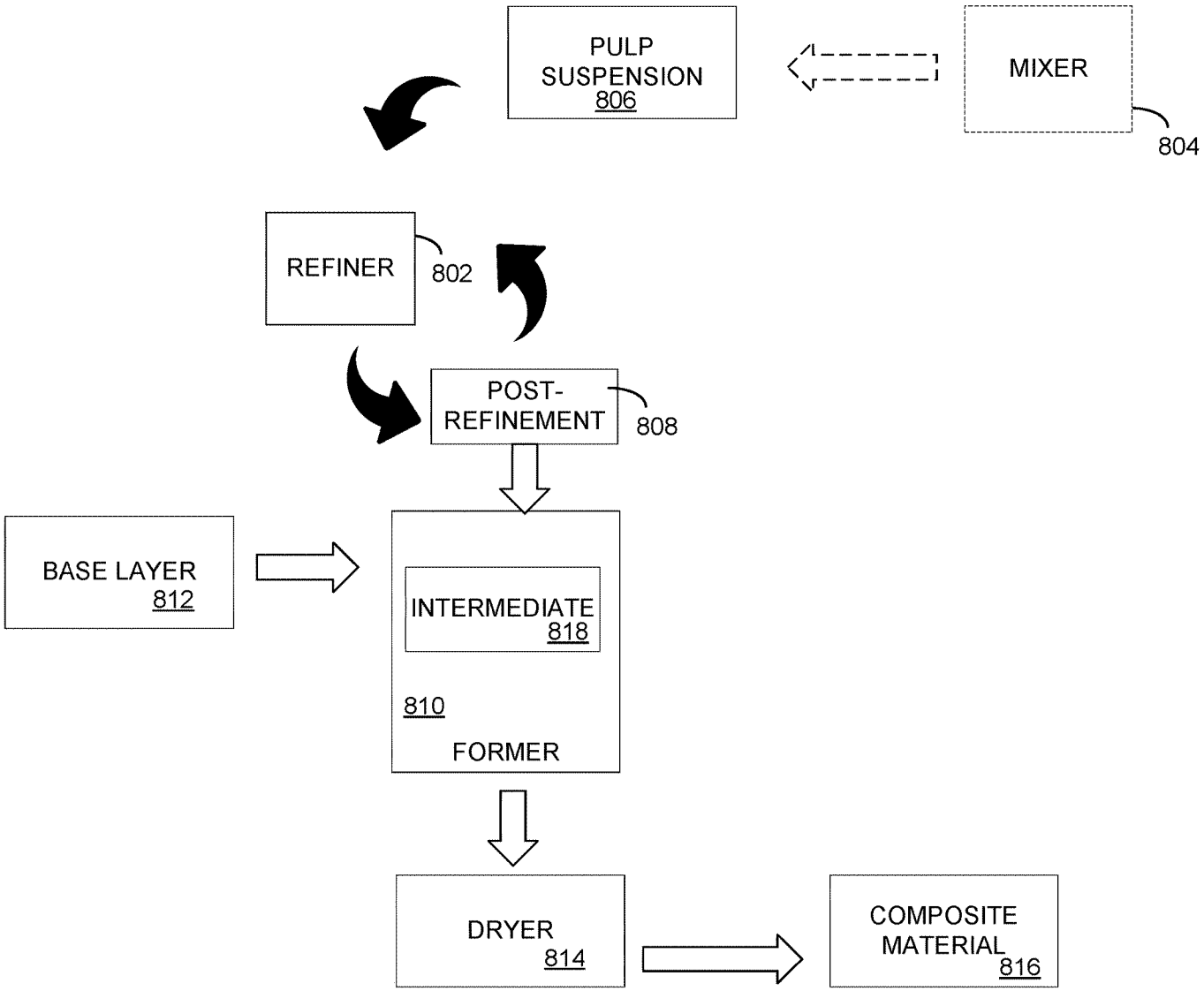
FIG. 8 is a flow diagram of a method for generating a material according to one embodiment.

Referring now to FIG. 8, a flow diagram may illustrate a method for creating such material according to one embodiment. In one embodiment, the examples shown below are generally free from toxic chemical additives to improve mechanical properties of the composite material. For example, a cellulose paper board (about 3.0 wt. %) was torn into pieces such as A4 sized paper. The shredded pieces is thrown into a pulping machine (not shown in FIG. 8). The pulping process may take about 20 minutes. Next, for example, a refiner 802 may be used to begin the process. For example, the refiner 802 may be a homogenizer, a grinder, a chemical refinement chamber/bath, a combination of a mechanical and chemical fiber refinement device, or the like. In one embodiment, in the example of a grinder, the refiner 802 may include a two grindstones facing each other. The separations or distances between the two grindstones may be adjusted as a function of the desirable end products. In another embodiment, surface grooves or patterns may be adjusted as a function of the desirable end products. As such, a pulp suspension 806 is then fed into the refiner, optionally for about 1-10 passes. In other instances, the pulp suspension 806 may be fed into a refiner (not shown), e.g., colloid mill, double disk grinder, to refine further the cellulose pulp before entering the refiner 802.

In one embodiment, FIGS. 1*a* to 1*d* show the condition of fibrillated cellulose with increasing numbers of passes. For example, FIG. 1*a* may represent a cellulose fibers aqueous suspension with 0 cycle or pass. In other words, the content of the pulp suspension 806 as shown in FIG. 1*a* where the pulp forms no fibrillation to achieve the qualities and properties of aspects of the invention.

In one embodiment, FIG. 1*b* may illustrate a post-refinement 808 where the pulp suspension 806 has passed the refiner 802 after 1 pass. For example, the post-refinement 808 may now include fibrillated cellulose fibers aqueous suspension. In another example, FIG. 1*c* illustrates an image of a post-refinement 808 that has passed the refiner 802 after 2 passes or 2 cycles. In one example, the fibrillated cellulose fibers in the post-refinement 808 is finer than that of what's shown in FIG. 1*b*. FIG. 1*d* may illustrate an image of a post-refinement 808 after 3 cycles/passes. In such an embodiment, the post-refinement 808 may include even finer fibrillated cellulose fibers than that in FIG. 1*c*.

In one embodiment, different cellulose starting concentrations have been evaluated and tested. For example, the post-refinement 808 may include fibrillated cellulose fibers and water with concentrations of fibrillated cellulose at about 2.5 wt. % of cellulose (and 97.5% water), about 3.0 wt. % of cellulose, at about 3.6 wt. % of cellulose, or at about 4.0 wt. % of cellulose were tested and used.

For example, insufficient refining was found for the cellulose concentration of about 2.5 wt. % of cellulose, and the properties were not tested. In other words, fibrillated cellulose fibers concentration with about 2.5 wt. % or even regular pulp suspension solution may be insufficient for achieving properties of aspects of the invention. The fibrillated cellulose with the post-refinement 808 with about 3.0 wt. %, about 3.6 wt. %, and about 4.0 wt. % are termed herein as L028, L029, and L030, respectively, in FIG. 5.

In one embodiment, various properties of the fibrillated cellulose were tested. For example, in Table 1, the properties of mechanical, water vapor and gas permeability are shown.

TABLE 1

| Fibrillated cellulose | Approximate Cellulose pulp concentration | DRY tensile strength (MPa) | DRY tensile index (Nm/g) | WET tensile strength (MPa) | WET tensile index (Nm/g) | Water vapor transmission rate, WVTR ($g/m^2 \cdot h$) | Oxygen transmission rate, OTR ($cm^3/m^2$ 24 h) 5% RH | 50% RH |
|---|---|---|---|---|---|---|---|---|
| L028 | 3.00% | 90 ± 5 | 105 ± 6 | 10 ± 2 | 10 ± 3 | 920 | 0.1 | 0.010 |
| L029 | 3.60% | 90 ± 5 | 100 ± 4 | 8 ± 2.00 | 6 ± 2 | 925 | 0.1 | 0.1 |
| L030 | 4.00% | 80 ± 6 | 95 ± 15 | 8 ± 2 | 7 ± 2 | 1015 | 1 | 0.500 |

Figure 2:
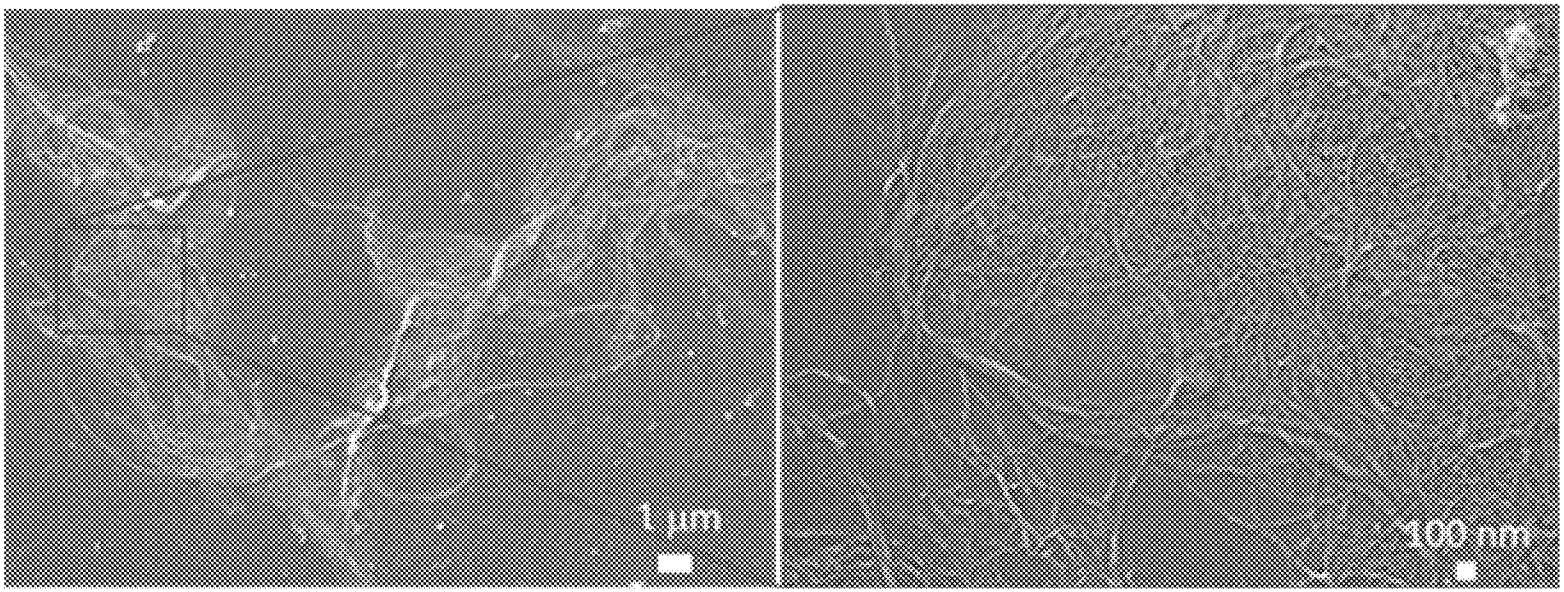
FIG. 2 is a scanning electron microscope (SEM) image for a material with fibrillated cellulose (3 wt. %) according to one embodiment.

In one embodiment, FIG. 2 may illustrate a SEM image of fibrillated cellulose at about 3 wt. % concentration.

Example 2

In one example, instead of using direct pulp solution to derive at the post-refinement 808, in Example 1 above, a semi-processed cellulose fibers may be obtained from a market source. As such, the semi-processed cellulose fibers (e.g., about 3 wt. %) is fed into a colloid mill and grind for about 1 minute. Optionally, the fibrillated cellulose fibers may further be processed in the refiner 802.

Figure 3:
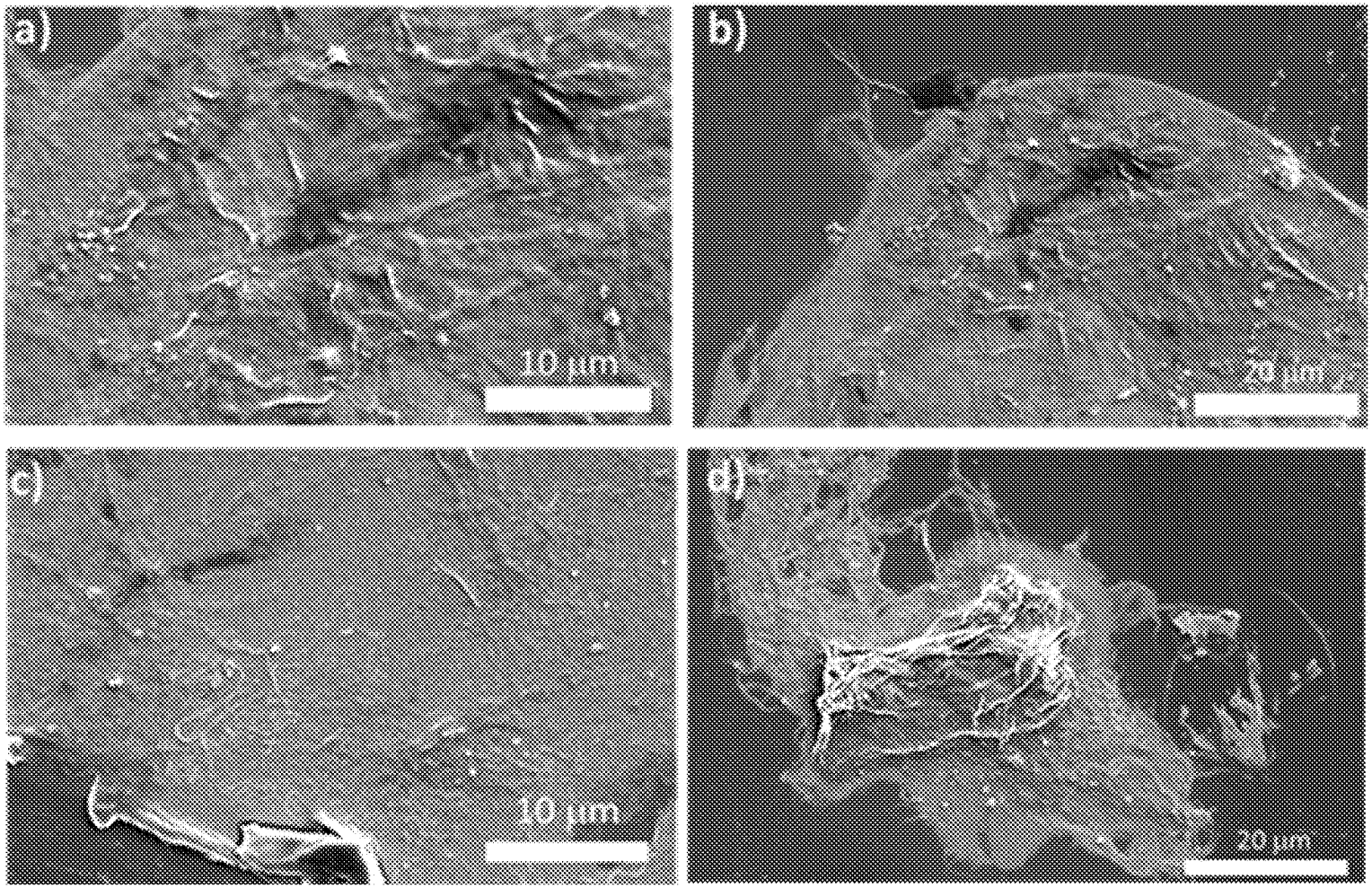
FIG. 3A to 3D are scanning electron microscope (SEM) images for semi-processed cellulose fibers where a-b are SEM images for Y-cellulose fibers and c-d for B-cellulose fibers according to one embodiment.

In one example, FIG. 3 may illustrate an SEM image for semi-processed fibers after colloid milling for 1 minute. For example, Table 2 shows the properties of different fibrillated cellulose from different source.

TABLE 2

| Fibrillated cellulose | Dry tensile strength (MPa) | Wet tensile strength (MPa) | OTR ($cc/m^2 \cdot 24$ h) 5% RH | OTR ($cc/m^2 \cdot 24$ h) 50% RH | WVTR ($g/m^2 \cdot 24$ h) |
|---|---|---|---|---|---|
| Y | 52.09 ± 7.75 | 6.99 ± 1.91 | 0.019 | 0.011 | 864.72 |
| B | 30.57 ± 3.64 | 2.01 ± 0.29 | — | — | 1075.68 |
| F | 38.97 ± 2.29 | 3.43 ± 0.20 | 115.44 | 92.98 | 1094.4 |

For example, FIG. 3 may illustrate where a-b are SEM images for Y-cellulose fibers in Table 2 and c-d are SEM images for B-cellulose fibers.

Figure 4:
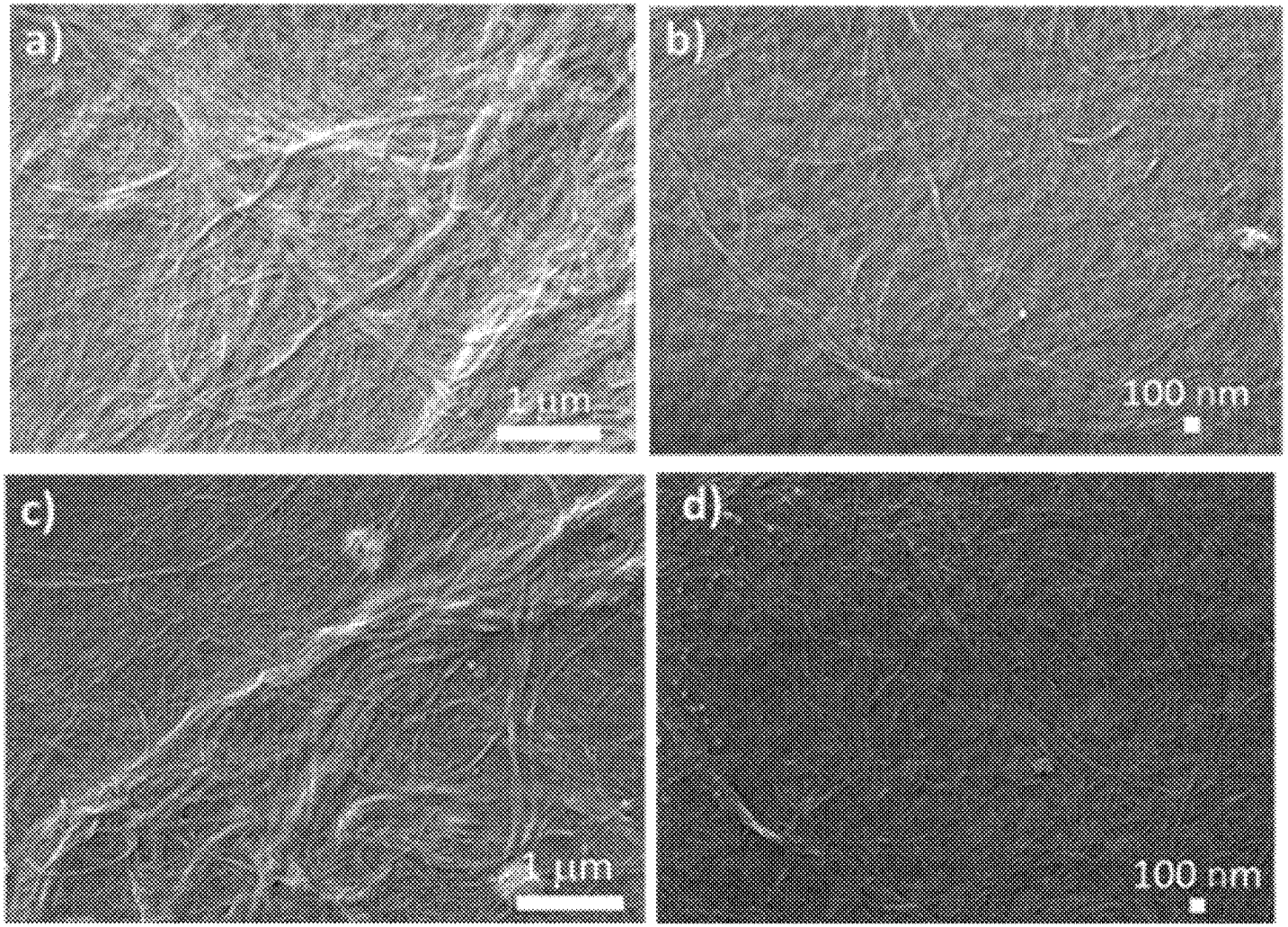
FIGS. 4A to 4D are SEM images for mechanically ground semi-processed fibers, where a-b are Y-cellulose fibers, and c-d for B-cellulose fibers according to one embodiment.

In another embodiment, FIG. 4 shows SEM images for semi-processed fibers after mechanically ground for 1 cycle/pass. For example, wherein FIG. 4*a-b* are for Y-cellulose fibers, and FIG. 4*c-d* are for B-cellulose fibers.

In one aspect, a mixer 804 may provide a suspension of pulp 806 of cellulose pulp in water comprises a mixture of cellulose pulp in water, wherein the cellulose to water weight ratio is about 0.01 to 100. In another embodiment, the weight ratio may be about 0.03 to 0.10. In some embodiments, the post-refinement 808 from the refiner 802 may be kept in the event that it may be used to be grinded again by the refiner 802. For example, as described above, the number of passes that the post-refinement 808 goes through the refiner 802 may be from 1-100. In another embodiment, the number of passes or cycles may be further limited to 1-10.

In another embodiment, a weight ratio of the fibrillated cellulose to water and/or the number of passes through the refiner 802 may be a function of the end products' desirable properties. For example, if the end product requires a low water vapor transmission, and a low oxygen transmission, then the post-refinement 808 may be with a weight ratio of cellulose to water closer to about 0.03-0.04 3-4% (as demonstrated by L28b-L30b) and/or the number of passes may increase. In yet another embodiment, the relative low water vapor transmission, and relative low oxygen transmission may indicate high shelf life while the relative high water vapor transmission and relative high oxygen transmission may indicate lower shelf life.

In one embodiment, the post-refinement 808 may be processed by a former 810. For example, the former 810 may generate an intermediate 818 based on the post-refinement 808 to a desirable material with the fibrillated cellulose. For example, the intermediate 818 may be at a ratio by weight of fibrillated cellulose to liquid (e.g., water) of about 0.001 to 99. In another embodiment, the ratio may be from about 0.001 to 0.10. In one embodiment, the former 810 may include a mesh or fibrous network. For example, the former 810 may include a negative pressure and/or positive pressure or any combination thereof. In one embodiment, the former 810 may apply pressure to separate the fibrillated cellulose in the post-refinement 808 from liquid to form the intermediate 818. Due to the fibrillated nature of the fibrillated cellulose fibers and through the process of the refiner 802, the fibers with different lengths may form the intermediate 818, as shown by the various SEM images in FIGS. 2-4 and 7.

In another embodiment, a base layer 812 may be used in conjunction with the post-refinement 808 to form the intermediate 818. In one embodiment, the GCM of aspects of the invention may include a composite material having a substrate layer of pulp (e.g., the base layer 812) and a fibrillated cellulose layer (e.g., from the post-refinement 808). For example, the former 810 may subject the base layer 812 to a mesh, a molding, or a frame to form a construct for the intermediate 818. For example, the base layer 812 may first be in a form of a solution or slush of water and pulp material. The slush may be in a tank and the mesh may be in the tank as well. Through a negative pressure such as a vacuum, water from the tank may be removed or reduced so the based layer 812 is formed on the mesh.

Subsequently, in one embodiment, the former 810 may include a sprayer or an applicator for spraying or applying the post-refinement 808 to the base layer 812 to form the intermediate 818. With the different sizes of fibers between the base layer 812 and the post-refinement 808, the post-refinement 808 is infused with the base layer 812. In one embodiment, the post-refinement 808 may be applied or sprayed on a surface of the intermediate 818 that carries edible items. For example, suppose an end product is a bowl, the post-refinement 808 may be applied or sprayed onto an interior surface of the end product.

In one embodiment, the intermediate 818 may exhibit patterns of the mesh or the fibrous network, as shown in 502 or 504, on an exterior surface thereof.

In yet another embodiment, the former 810 may spread the intermediate 818 on a flat surface for drying or forming by natural process.

In another embodiment, a dryer 814 may further be provided to dry or dehumidify the intermediate 818. In one embodiment, the dryer 814 may provide a drying condition of 30° Celcius to 200° Celcius. In another embodiment, the dryer 814 may include a heated surface, such as an infra-red heating. In another embodiment, microwave heating or air heating may be used without departing from the spirit and scope of the embodiments. In yet another embodiment, the dryer 814 may also be aided by negative pressure and/or positive pressure.

Example 3

In one example of the end products that may embody aspects of the invention, a cellulose based bowl is successfully produced by adopting combinations of materials and methods described previously. In one embodiment, the functionality of the cellulose based food container, in this example, may be used to prove filling typical cooking oil into the container, as shown in FIG. 5. In this example, the cooking oil with the cellulose-based food container may be heated by microwave at 800 W for 4 minutes and observed for 10 days, which is shown in FIG. 5. In such illustration, the container in FIG. 5 may represent ones made of fibrillated cellulose L28b, L29b, L30b, and Y. In one embodiment, each of the ones in FIG. 5 may be able to hold oil for about 10 days.

In another embodiment, another set of testing was also carried out by filling instant noodle (after it is cooked after hot water is added) into a container embodying the composite material according to one embodiment. The observations were recorded on the second day. FIG. 6A shows an example of a fibrillated cellulose structure in a container, such as a food container. For example, FIG. 6A illustrates a series of images of a fibrillated cellulose filled with boiling water and let it stand for about 5 minutes.

In another embodiment, FIG. 6B illustrates a series of images of the fibrillated cellulose filled with boiling water and microwave heated at 800 W for about 2 minutes.

FIG. 7 is another image showing a SEM image for a structure of fibrillated cellulose in food container in FIGS. 6A and 6B according to one embodiment.

Example 4

Figure 9:
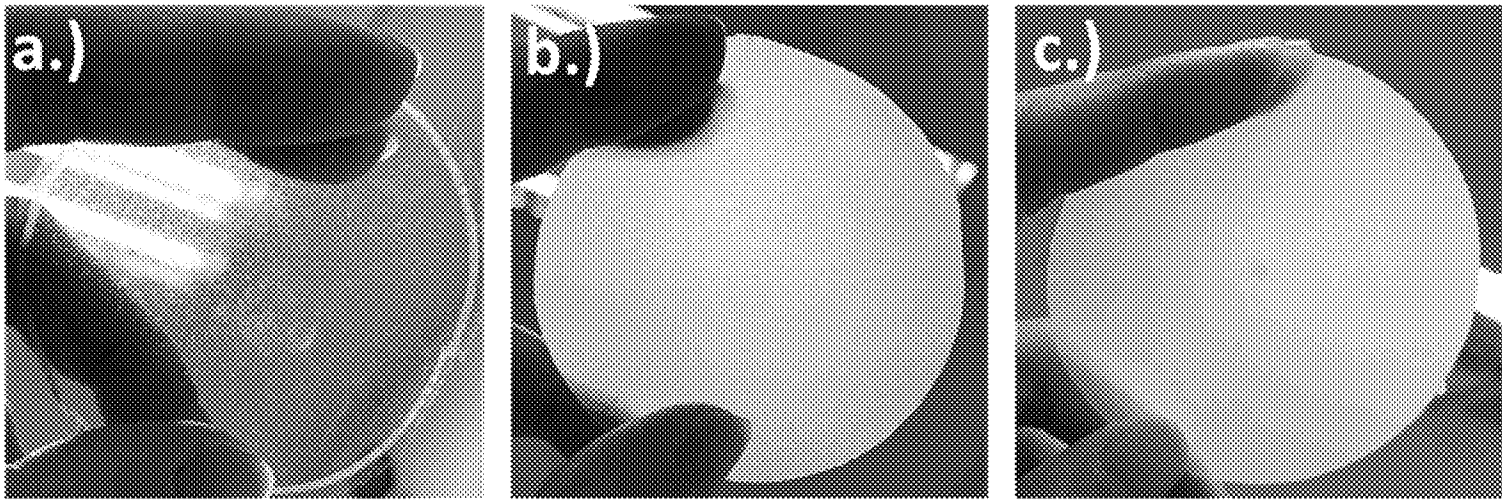
FIG. 9 illustrates three images showing a film according to one embodiment.

Referring now to FIGS. 9*a* through 9*c*, images illustrate a film according to example 4 of an embodiment.

In one embodiment, a composite material according to aspects of the invention may be in a transparent composite film based on fibrillated cellulose. In one example, the film may be produced by dissolving the fibrillated cellulose and pullulan powder in water to produce solutions containing about 1 wt. % of solute, separately. In the pullulan powder dissolution, the powder may be progressively added thereto, and the solution may be heated via microwave at power of 800 W for 1 minute. In one embodiment, this process may repeat for about 4-5 times until a clear solution is formed.

In one embodiment, to produce a composite film, the fibrillated cellulose, such as the post-refinement 808, to pullulan may be with a ratio of about 1:1, For example, about 250 g of the post-refinement 808 (e.g., the fibrillated cellulose of about 1%) may be mixed with about 250 g of pullulan solution to produce a solution with about 0.5% solute. Then, about 100 g of the mixed solution was poured onto a hydrophobic surface, e.g., silicone surface and allowed to dry at room temperature.

In another embodiment, a fibrillated cellulose to a pullulan with a ratio of 2:1, 250 g of the post-refinement (e.g., the fibrillated cellulose of about 2%) may be mixed with about 250 g of pullulan solution to produce a solution with about 1% solute. Then, about 100 g of the mixed solution was poured onto a hydrophobic surface, e.g., silicone surface and allowed to dry at 50° C. and 12 hours.

As illustrated, FIGS. 9*a* through 9*c* may illustrate images of cellulose based film where fibrillated cellulose to pullulan with a ratio of a.) 0:1, b.) 1:1, and c.) 2:1.

In one embodiment, the addition of pullulan may enhance the film forming process to smooth the film's surface, where film made of fibrillated cellulose (e.g., the post-refinement 808), herein termed as L41b below, is highly wrinkled. Whereas the other films with pullulan provide smoother and even surface. In one embodiment, the film of the composite material with the fibrillated cellulose and pullulan may be generally free from uneven surface.

In yet another embodiment, mechanical properties of transparent composite film were shown below, where fibrillated cellulose is denoted as L41b, and pullulan is represented as B.

TABLE 3

Properties of fibrillated cellulose films with the addition of pullulan.

| Sample | 100B | L41b:B 1:1 | L41b:B 1:1 | L41b:B 2:1 | L41b:B 1:1, 6% WSA |
|---|---|---|---|---|---|
| Weight (g) | | 0.75 | 1 | 1 g | 1 |
| Thickness (mm) | 0.025 | 0.035 | 0.06 | 0.05 | 0.06 |
| Dry Tensile Strength (MPa) | — | 33.54 ± 5.49 | 42.07 ± 11.13 | 50.055 ± 6.98 | 60.9 ± 5.17 |
| Dry Young's Modulus (MPa) | — | 1176.01 ± 1469.73 | 6062.55 ± 886.95 | 13481.95 ± 13055.80 | 8203.87 ± 588.09 |
| Dry Tensile Index (Nm/g) | — | 38.95 ± 5.58 | 39.94 ± 6.23 | 51.54 ± 8.07 | 54.73 ± 6.67 |
| Wet Tensile Strength (MPa) | N.A | N.A | N.A | | 4.64 ± 1.11 |
| Wet Young's Modulus (MPa) | N.A | N.A | N.A | | 185.97 ± 228.53 |
| Wet Tensile Index (Nm/g) | N.A | N.A | N.A | | 3.98 ± 0.81 |
| OTR 5% RH | | | 0.055 | | |
| ($cm^3/m^2$ 24 h) 50% RH | | | 0.137 | | |
| WVTR ($g/m^2h$) | 103.16 | 76.57 | 67.09 | 69.01 | |

Example 5

Fibrillated Cellulose with Water Repellant

In one embodiment, aspects of the invention may include fibrillated cellulose with water repellant. In one example, the mixture may include a correct ratio of cellulose and a water repellant, and blended for 3 minutes using a mechanical blender. The mixture may further be diluted to 4000 mL and pour onto the former 810. In one aspect, the former 810 may apply negative and/or positive pressure to produce a wet preform with a dryness of 25-35%. The mechanical and barrier properties of the mixture may be shown in Table 4.

TABLE 4 illustrates properties of fibrillated cellulose films with different water repellant.

| Sample Name | M055 + 10% Carnauba wax | M055 + 20% Carnauba wax | M055 + 10% Canola oil |
|---|---|---|---|
| Weight (gr) | 5 g GCM + 0.5 g wax | 5 g GCM + 1 g wax | 5 g GCM + 0.5 g oil |
| Thickness (mm) | 0.156 | 0.168 | 0.154 |
| Tensile Strength (MPa) | 78.96 ± 26.68 | 76.215 ± 14.75 | 86.47 ± 4.8 |
| Young's Modulus (MPa) | 7611.49 ± 788.28 | 7485.75 ± 332.20 | 8045.41 ± 742.03 |
| Tensile Index (Nm/g) | 88.85 ± 27.80 | 86.69 ± 21.71 | 96.34 ± 2.72 |
| Wet tensile Strength (MPa) | 11.14 ± 2.48 | 15.10 ± 2.29 | 9.03 ± 1.48 |
| Wet Young's Modulus (MPa) | 1258.27 ± 203.63 | 1720.10 ± 407.88 | 949.51 ± 61.29 |

TABLE 4-continued illustrates properties of fibrillated cellulose films with different water repellant.

| Sample Name | | M055 + 10% Carnauba wax | M055 + 20% Carnauba wax | M055 + 10% Canola oil |
|---|---|---|---|---|
| Wet Tensile Index (Nm/g) | | 12.10 ± 2.27 | 16.82 ± 2.81 | 9.69 ± 1.52 |
| GTR | 0% RH | | | 75.88 |
| ($cm^3/m^2 \cdot 24$ h atm) | 50% RH | | | 4701.98 |
| OTR | 5% RH | 0.047 | 0.104 | 0.009 |
| ($cm^3/m^2 \cdot 24$ h) | 50% RH | 0.044 | 0.022 | 0.040 |
| WVTR ($g/m^2 \cdot 24$ h) | | 614.4 | 411.6 | 905.52 |

In addition, the above embodiments may be made using the devices shown in FIGS. 10A to 13. From the simplified diagram in FIG. 10A, the 1000 component may be regarded as a container. After the pulp is loaded, the paper fiber may be received by the 1001 from the water tank containing the pulp using its vacuum principle. For example, 1001 may include a fiber catcher. For example, the fiber joint may be a mesh, because the paper fibers of the water tank may stay in the mesh body, and the liquid will pass through the mesh. The vacuum principle includes first pumping and discharging the water in the water tank, and then allowing the vacuum environment to be tightly received on the 1001 component to make a first material. In one embodiment, the component 1001 may be rotated to have the component facing upward or downward to enter into the container 1000 to form the final product. The component 1001 may be rotated again (e.g., 180 degrees) so that any remaining moisture or water or liquid may be extracted.

Figure 10A:
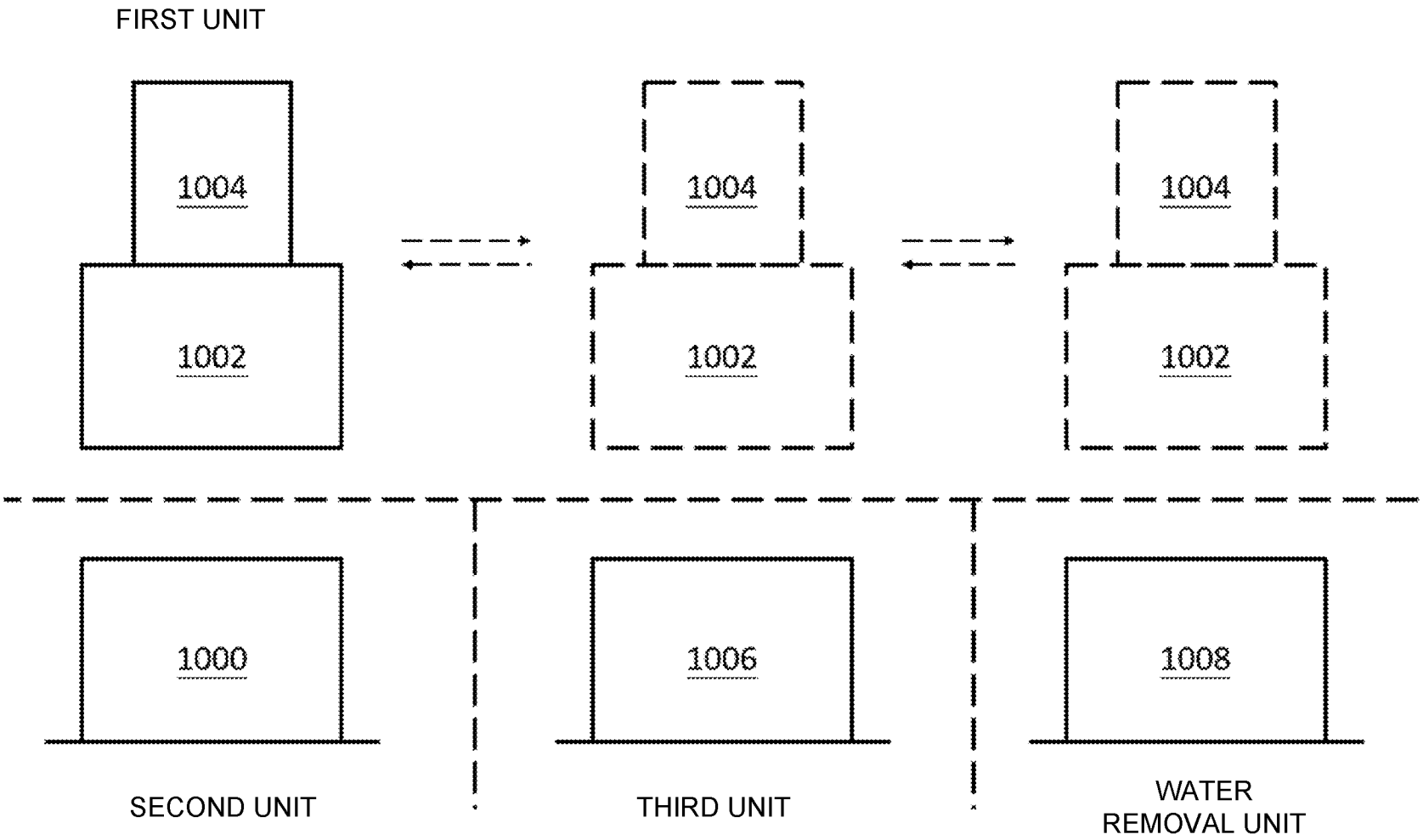
FIGS. 10A to 13 illustrate apparatuses according to one embodiment.
Figure 10B:
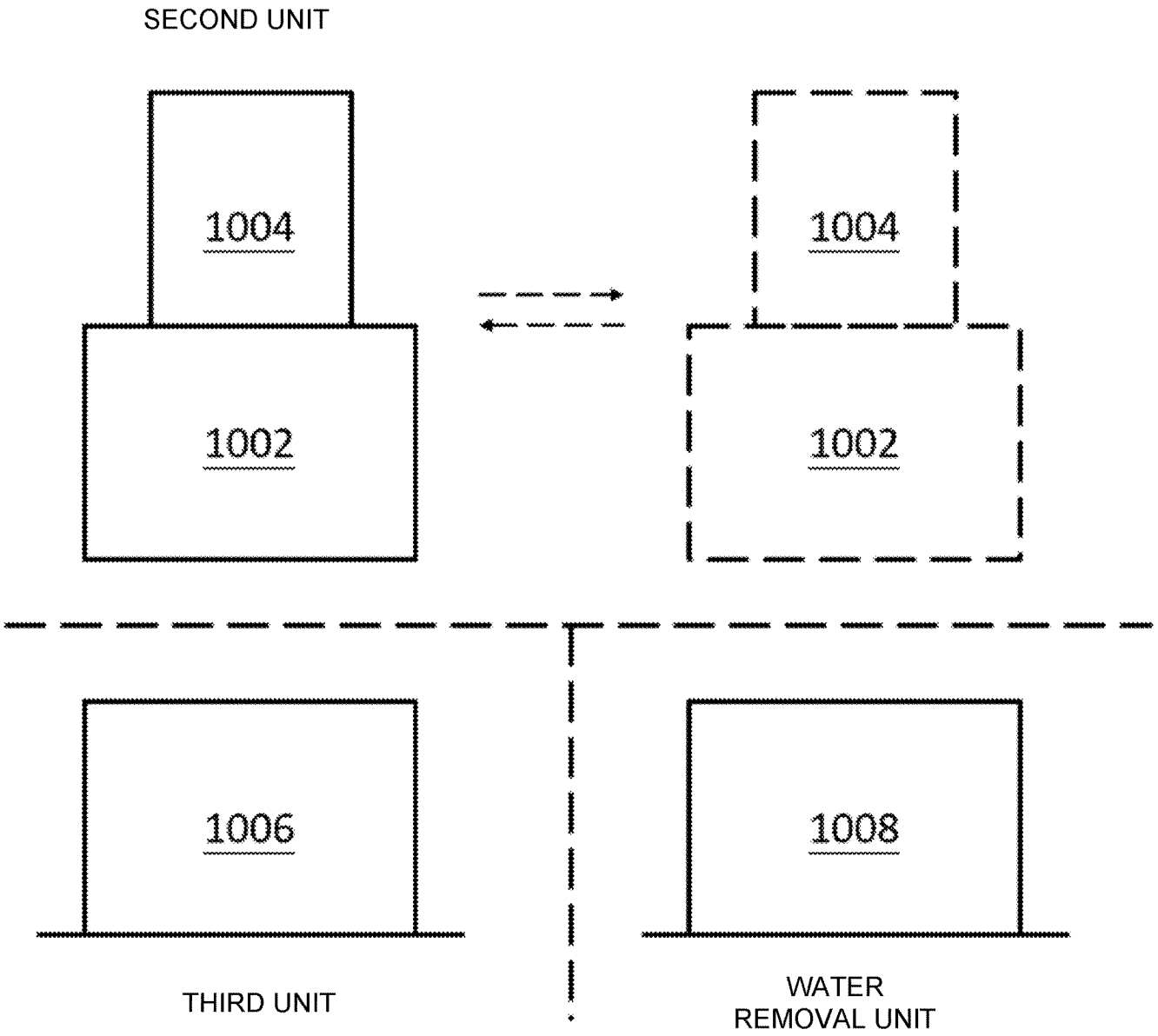

In another embodiment, a component 1004 may be connected to a component 1002, and the component 1004 may move its vacuum suction function up, down, left, and right, and the component 1004 may be installed and configured with its component 1002. In one embodiment, component 1002 may be used to receive the first material on the element 1001. As shown in FIGS. 10A and 10B, the components 1002 and 1004 may be moved to the third unit or the water removal device. Similarly, in one embodiment, the component 1002 may be rotated to have the water removed. In addition, the arrangement of the present invention in the components 1000, 1002, 1004, 1006, and 1008 does not require linear arrangement. Since the component 1004 may move in multiple directions, 1000, 1006 or 1008 may be circular, triangular, above, below and other relative positions. In addition, the component 1004 may include a robotic arm or device to move. In another embodiment, the component 1004 may be moved manually, and may be moved to 1006 or 1008 by mechanical, rotating disk, or with rail assistance, either manually or with motorized assistance (e.g., such as with robotic arms). In some embodiments, the component 1004 may be moved individually or collectively when multiple components 1004 may be employed.

In some embodiments, in a singular manufacturing process, such as one product item or a molding loading process, the second material may be received through 1002 and 1004. In such an embodiment, the second material is effectively added to the first material by the components 1002 and 1004. For example, the second material may be joined to the first material through the component 1006, and as in the above example, the first and second materials are closely mixed to form a third material. In another embodiment, the third material may show that the first material and the second material exhibit different layers.

In another embodiment, where multiple station configurations are employed, the components 1000 and 1001 may receive the first material. The components 1001 and 1006 may receive the second material. As such, such multiple station configuration may produce two different products. As the components 1002 and 1004 move the materials to the next station, the two different products may be produced simultaneously or substantially simultaneously. In such embodiments, the time needed for producing different products are greatly reduced and the space needed to for the equipment may be reduced as well.

In some embodiments, the container or workstation storing the second material additionally adds a source of heat or heating. For example, the component 1002 or 1004 itself or an additional heating source may perform the function of holding or heating the container, so that the second material may be mixed with the first material or before the second material is mixed with the first material to about 40 or more degrees Celsius to obtain the best and most efficient production of the final product efficiency. In another embodiment, the heating source may be heated by means of electric heating, steam, liquid or the like.

In one embodiment, after the first and second materials are mixed, as described above, the components 1002 and 1004 are moved to a component 1008 dewatering station to perform the steps of water removal or water reduction. For example, after mixing the first and second materials for the components 1002 and 1004, the third material may be moved from the component 1006 to the component 1008. In another embodiment, the third material is in a vacuum-sealed state during the mixing process of the components 1002, 1004, 1006, and 1008 during the mixing of the third material, and then the positive pressure function or pressurization function is used on the component 1008 to make it load the space for combining the materials. As the pressure increases, the moisture or water in the third material is eliminated, and the original negative pressure design of 1002 and 1004 will further pump the combined material or reduce the dry humidity of the combined material. In some embodiments, the component 1008 may be rotated.

Finally, the combination of materials into the shaping stage to make the final product.

In another embodiment, the second material may also directly serve as the main body of the third material, as shown in FIG. 10B. For example, after entering the second element in FIG. 10B, the second material is not mixed with the first material.

Figure 11A:
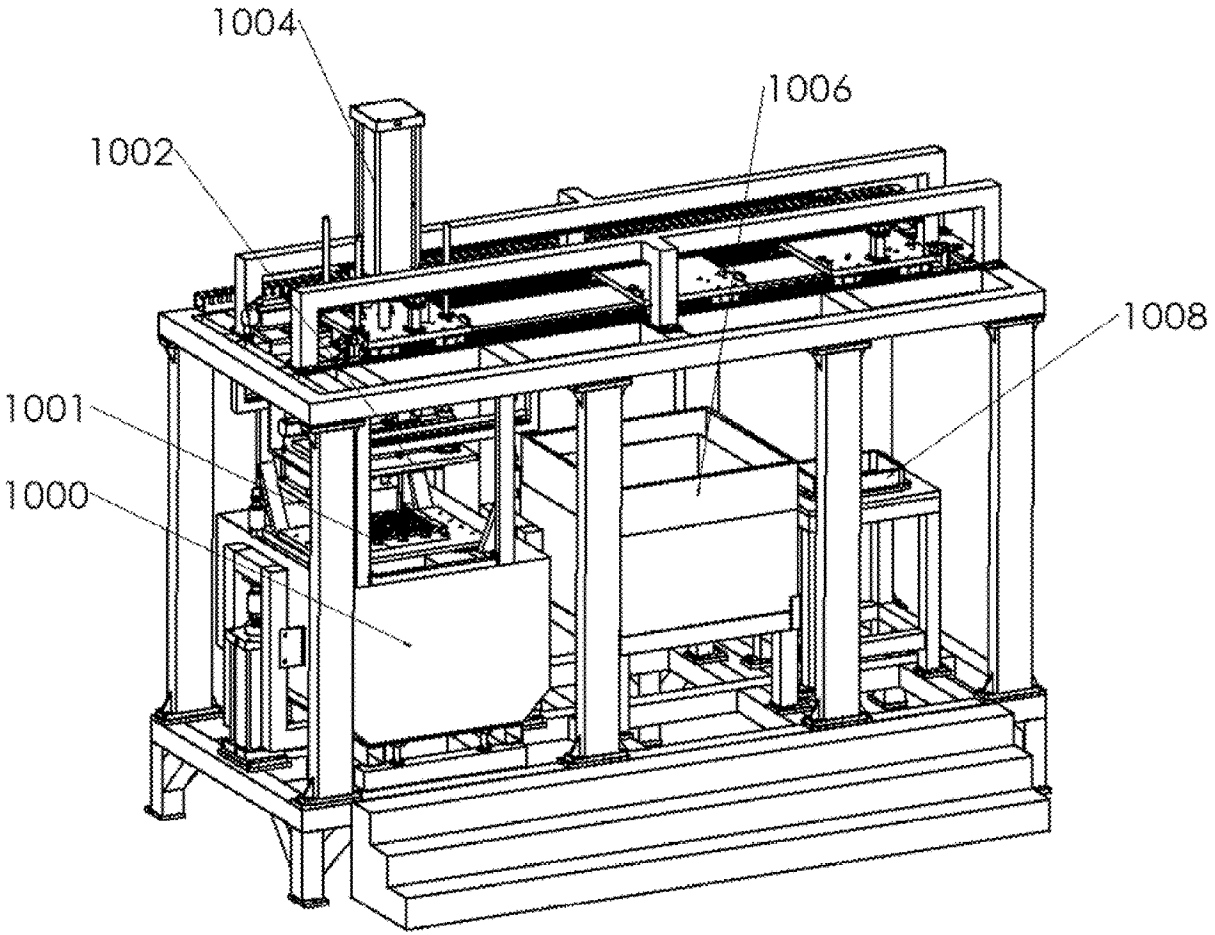

The device of the present invention may be an automated device, as shown in FIG. 11A, that is, the first unit, the second unit, and the third unit are a set of coherent devices.

Figure 11B:
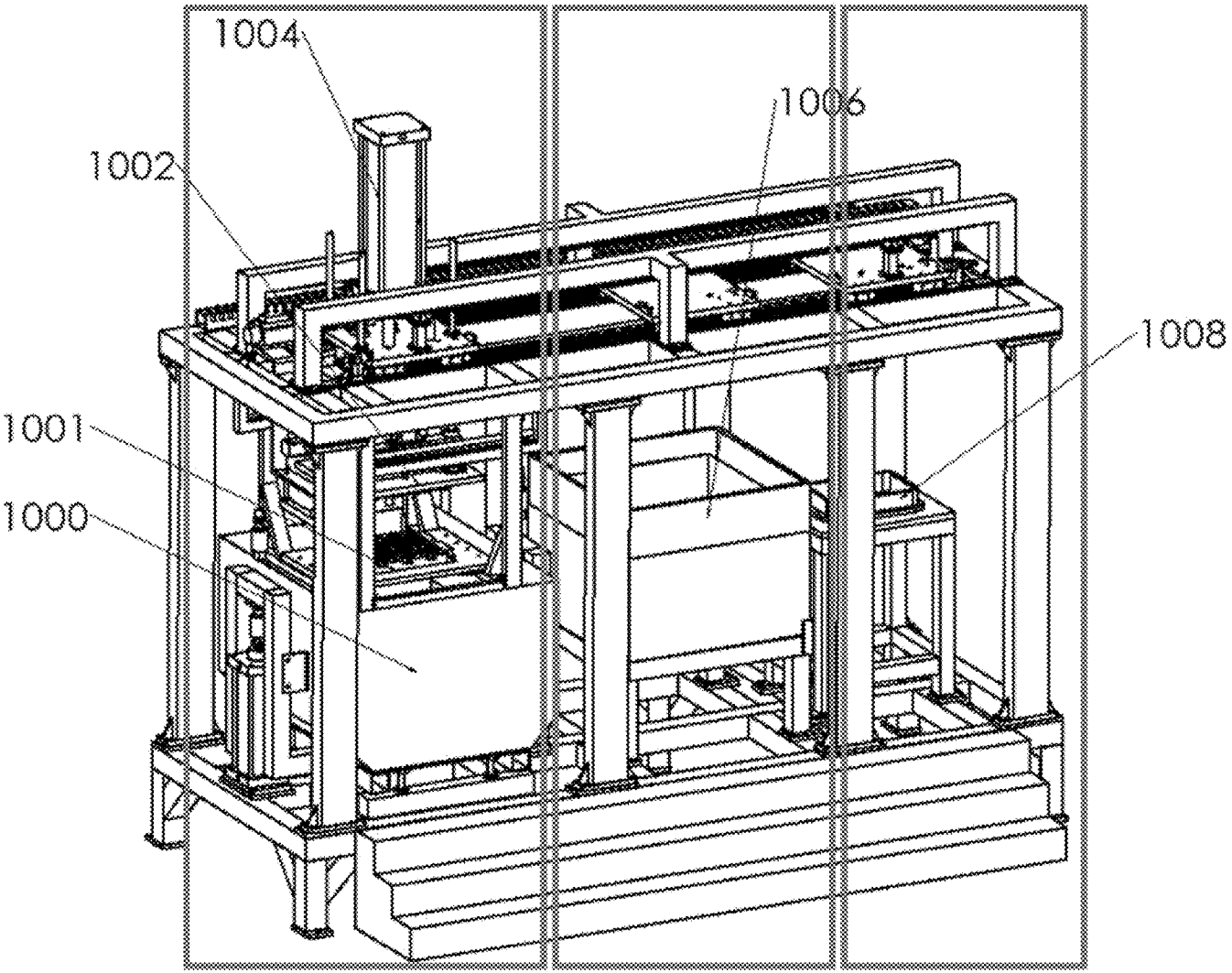
Figure 11C:
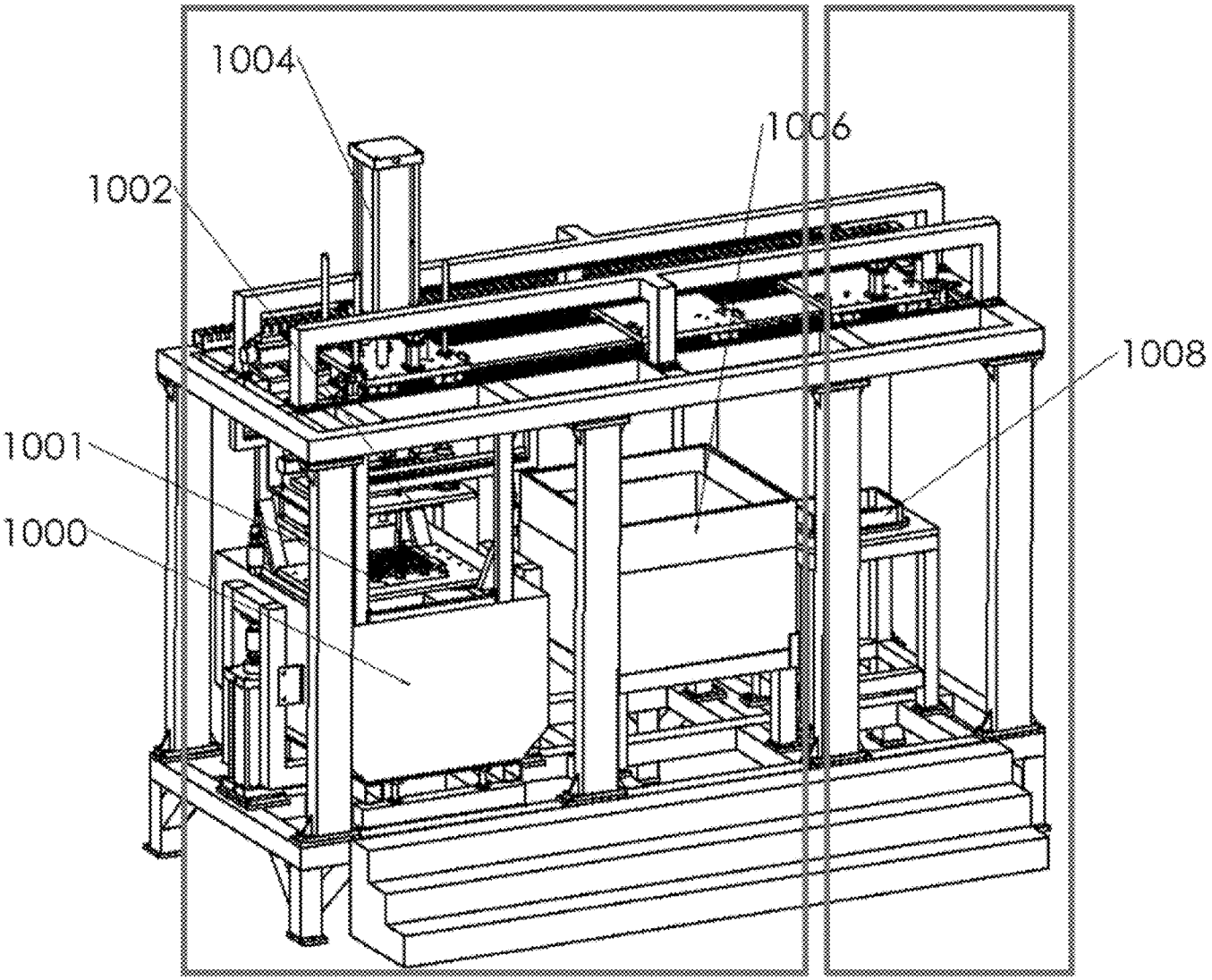
Figure 11D:
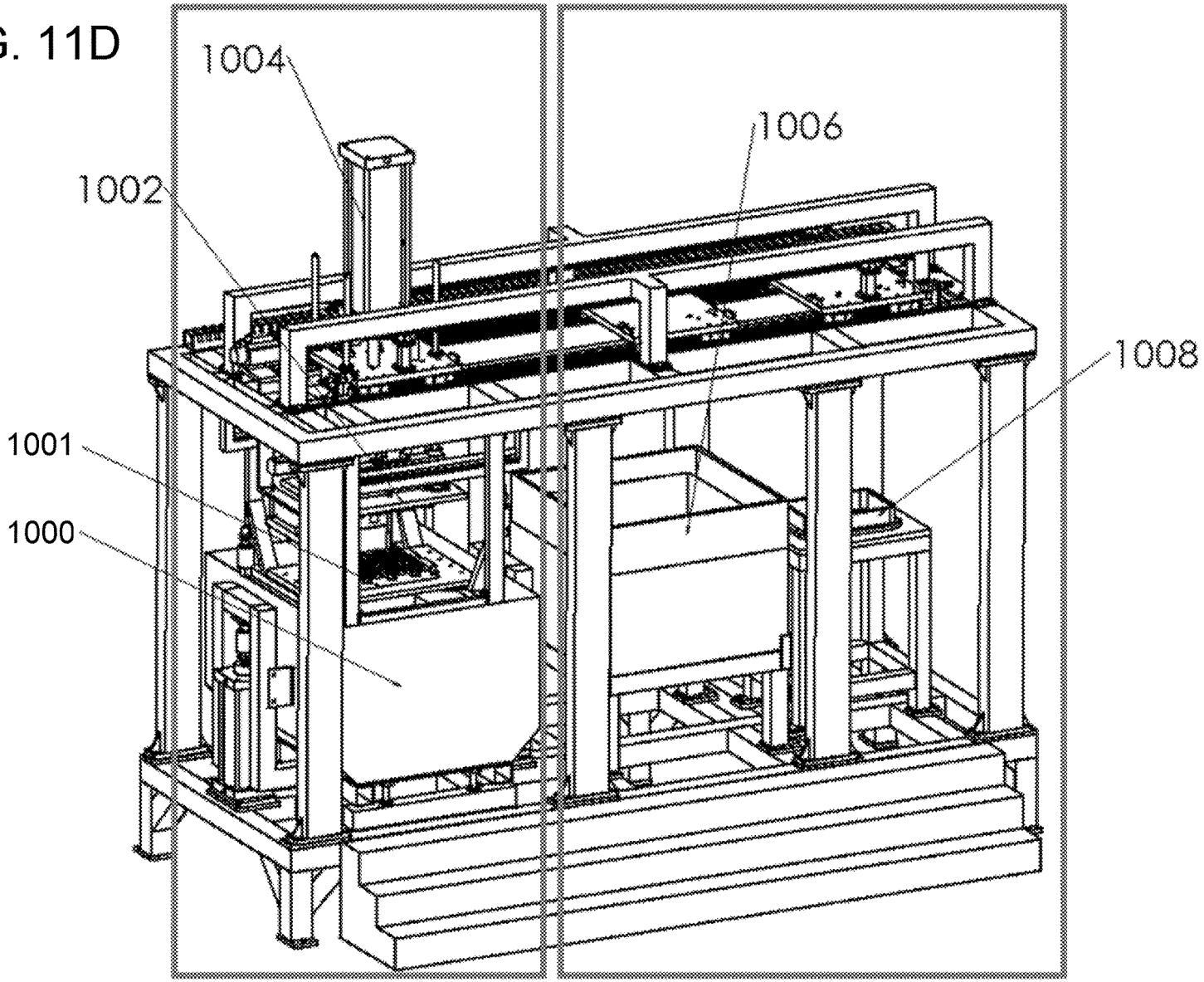

In another embodiment of the present invention, as shown in FIGS. 11B, 11C, and 11D, the third material may be made detachable and separated with a combination of components.

In addition, FIGS. 11A to D show that the component 1004 is moved by a track, but those skilled in the related art may easily use other methods to move the component 1004 without departing from the basic principles of the present invention, and the movement does not need to be limited to move in the same plane.

In addition, embodiments of the present invention also includes a software system to operate the apparatus of the present invention, including sensors at the components 1000, 1001, 1002, 1004, 1006, 1008, etc. to transmit parameter information. The software system also may include different interfaces, whether it is a centralized interface or may be presented on a mobile device via the network. Even as shown in FIGS. 11B to 11D, in different embodiments, separate components may have a continuous or separate interface and software to communicate and operate the operation of the units or components. The software system also may report notifications and warning functions to provide administrators with efficient management of the production process.

The molding and the transfer molding have a rotational feature in some embodiments. For example, the component 1001 (e.g., molding) may include a rotation or flip capability via an axis. During the molding process, the molding surface may be upward or downward into the 1000 slurry container or bucket using vacuum or absorption mechanism. In one example, the component 1002 that transfer the component 1001 also may include the rotation function. In one aspect, the component 1001 may be rotated after the product is transferred, and the water or moisture may be discharged by means of vacuum or gravitational force.

Grouting: When 1001 and 1002 are mated or joined, in one example, a pouring cavity may be inside the component 1001, and may use a pump to feed the material in the container 1000 into the cavity of the component 1001, and then the water therein may be drawn or taken out by vacuum or other forces. Once, the first material is completed, the second material may be completed by applying the component 1006 in the same way. In one example, in using the components 1000 and 1006, the slurry bucket (e.g., container 1000) may be installed at any position below or above the equipment.

Figure 12A:
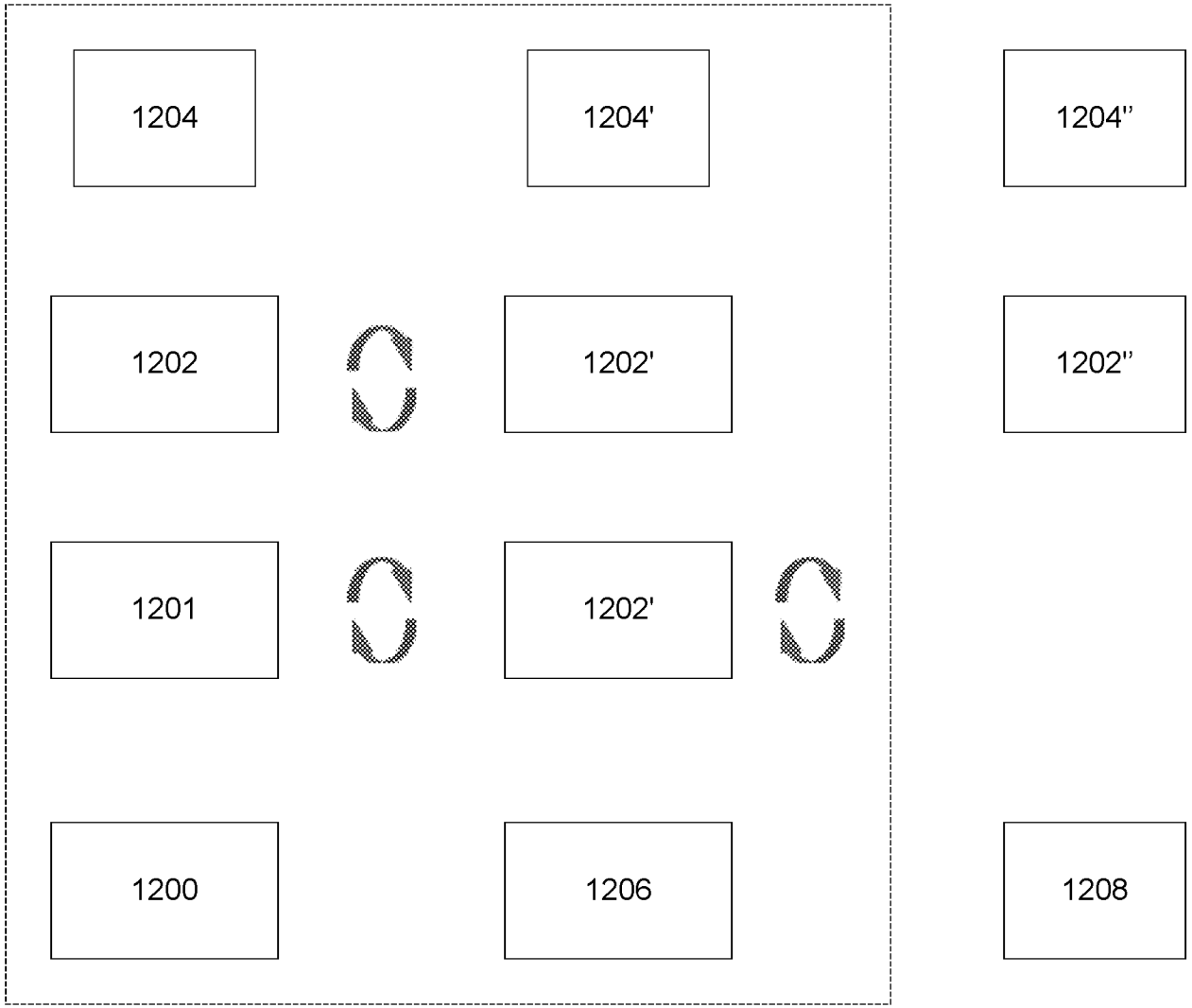
Figure 12B:
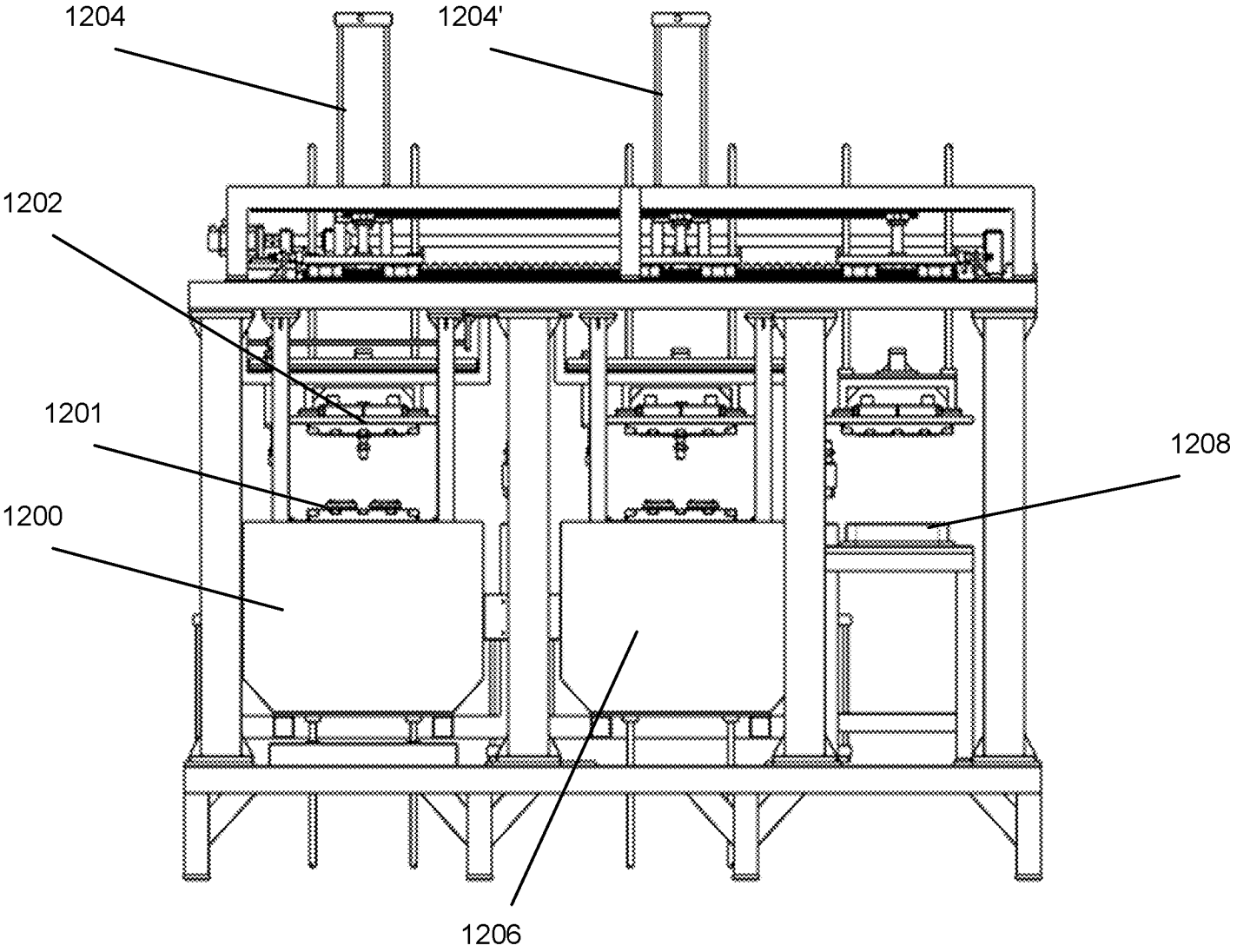

FIGS. 12A and B may now illustrate another embodiment of the device, which is also an extension of FIGS. 10A-11D. For example, the paper forming process may include: 1. decompose the cardboard into pulp through the pulping system. The pulp may be mixed with other materials required for the pulp before entering the forming system. 2. Use vacuum or suction force as the power to attach the pulp material to the surface of the mold, and then use the drainage system on the surface of the molding to drain the excess water, so that a thin layer of wet material is formed on the surface of the mold. 3. After molding, the surface of the product needs a lot of moisture. Natural air drying, hot air, air pressure, molding heating and other methods may be used to assist hot pressing to drain the remaining moisture of the material.

The above description provides the following molding processes:

(A) Slurry molding method—the molding method is to use the inside of the molding to make a vacuum cavity. Under the action of vacuum, the fibers of the pulp may be uniformly layered and attached to the molding net on the surface of the mold, and the molding surface faces upward into the pulp in the tank, a large amount of water will be taken away by vacuum suction. When the product reaches a certain thickness, the product molding will leave the pulp tank, and the wet pulp on the surface of the molding will be dehydrated.

(B) Grouting method—the surface of the molding is facing upwards, a pulp tank will be made around the mold, the pulp will be connected to the pulp tank by means of a pulp pipeline, the pulp will be given the amount of pulp according to the thickness of the product, and one will be made inside the molding In the vacuum cavity, the pulp fibers may be uniformly layered and attached to the forming net on the surface of the molding under the action of vacuum, and a large amount of water will be taken away by vacuum suction, which forms a wet preform on the surface of the molding and the pulp fibers is then dehydrated.

(C) Reverse suction molding method—the surface of the molding faces down into the pulp tank, and a large amount of water will be taken away by vacuum suction. When the product reaches a certain thickness, the product molding will leave the pulp tank, and the wet pulp on the surface of the molding will be dehydrated.

In one aspect, embodiments of the invention effectively combine at least two materials, through the characteristics of the fiber itself and fibrillated cellulose, using the specific arrangement in the process, the two or more layers are more closely combined or bonded.

In one example, FIGS. 12A and B illustrate a horizontal, linear or a substantially linear system where, 1204, 1204' and 1204" may be fixing units, 1202, 1202', 1202" may be transferring element, 1201, 1201' are moldings or mesh, and 1200 may be the first layer of a material; 1206 may be a second material; and 1208 may be a dehydration or positive press component. The feature of this equipment may be a horizontal or a linear system (in terms of flow of end product), a multi-station system, or an assembly line, and 1202 or 1201 may be rotated, and 1201' may also be rotated.

Figure 13:
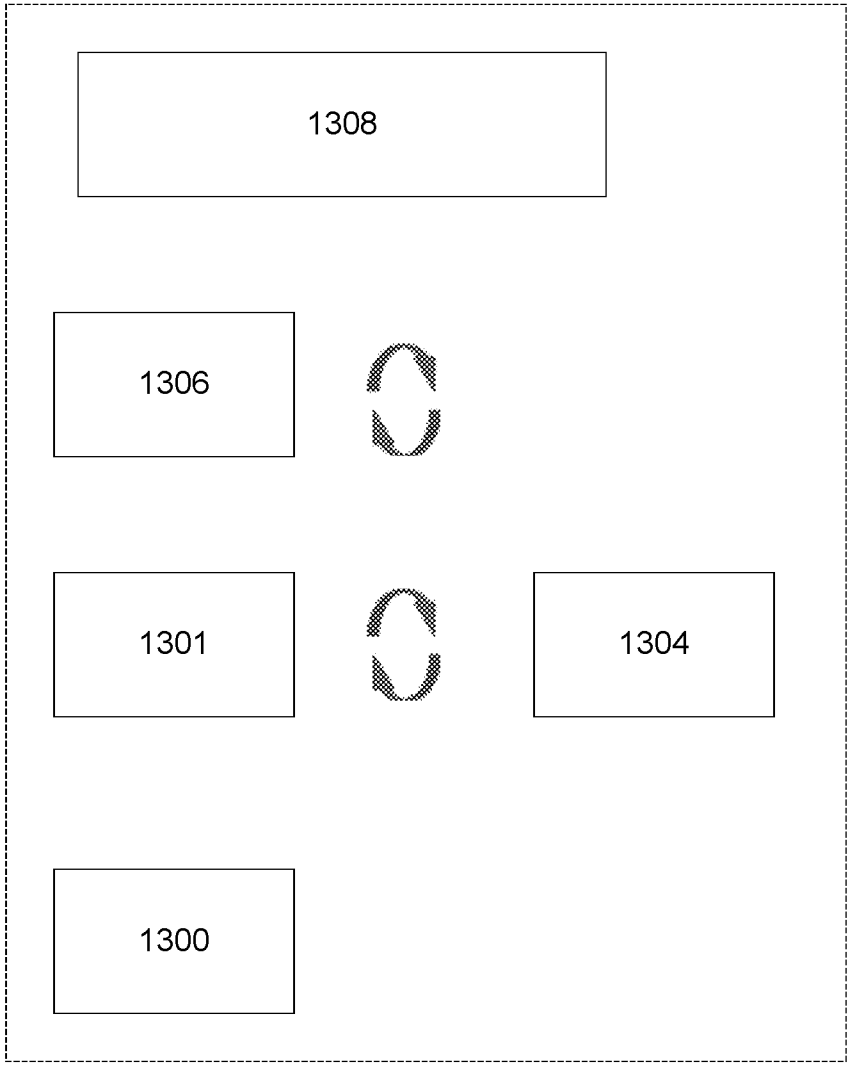

Or the vertical system as described in FIG. 13. The vertical system includes 1304 as a fixing unit, 1301 as a mold, 1300 as a first material, 1306 as a second material, and 1308 for dehydration, dewatering, positive pressure, hot air, compression, heating, and other machines. Among them, the 1301 molding may be designed for rotation.

In another embodiment, the systems of FIGS. 12A and B and FIG. 13 may be partially combined.

From the above embodiments, the method of forming the container 1 of the first material and the container 2 of the second material may include one or more features:

In the vertical system, if one wishes to complete the two moldings at the same time, one may cooperate with the rotation action. The molding workstation may use the injection+suction or suction+injection. The above rotation actions may be used: 1. Motor drive mechanism to rotate the mold, 2. the vertical movement of the molding drives the connecting rods, racks or mechanical structure equipment to rotate.

In addition, the present invention may further enable the following combinations to achieve processes that were not possible in the past:

| | Former or Forming Station | | |
|---|---|---|---|
| | Single unit or Vertical System | | Linear (through manual, |
| material 1 + material 2 | Sequence of 1 and 2 | Molding rotation | robotic arm, assembly line or rotation) |
| A + A<br>A + B<br>A + C | separate | | separate or concurrently |

-continued

| | Former or Forming Station | | |
|---|---|---|---|
| | Single unit or Vertical System | | Linear (through manual, |
| material 1 + material 2 | Sequence of 1 and 2 | Molding rotation | robotic arm, assembly line or rotation) |
| B + B | separate | | |
| B + A | separate | | |
| B + C | separate or concurrently | needed | |
| C + C | | | |
| C + A | | | |
| C + B | separate or concurrently | needed | |

Therefore, the above table shows that the equipment of the present invention may be equipped with multiple (more than one) slurries during the molding stage, which may produce different molding processes to fulfill other different product requirements:

Thick Material Finished Products with 2 mm or More:

After the forming station is completed, it may be connected or transferred to the 1008 dehydration process. The dehydration equipment of this equipment is equipped with positive pressure and compression devices, which may accelerate the time of pulp drainage and forming, which is beneficial for forming thick products.

Multilayer Transfer Stacking Molding (Including Composite Materials)

The use of a linear transfer system or a vertical rotation system may simultaneously complete the connection of the first layer of material and the second layer of material. The 1002 and 1004 transfer products may be used to stack two or more or the same materials together to make thick and thin composite materials.

Multi-Color Molding

The use of a linear transfer system or a vertical rotation system may simultaneously complete the molding of multi-color materials, and complete the blister process with different colors of pulp on a single product.

Dyeing and Molding

In the pulp blister molding process, the pulp dyeing needs to be replaced with other colors. It is a very time-consuming task to clean the pipeline. One may use the multi-pulp bucket to place the pulp dye in a separate molding bucket. After the first layer of material is formed, it may be moved to the second layer of dye to absorb the plastic dye, so that the surface of the pulp is attached to the color, and then transferred to the drying process. This system may shorten the time for the replacement of different color dyes without the need clean the pulping system.

Optimization of Additives

The timing of pulp additives in pulp molding is very important. One may add them and put them in a separate molding barrel. We may choose appropriate timing to add them to increase the ability of the additives to combine with the pulp fibers. Independent additives may also reduce the chance of pulp backwater being contaminated by additives in other systems will improve the quality of the backwater.

Multilayer Material Molding

With this, the forming process of the first layer material and the second layer material may be completed at the same time. The transfer products 1002 and 1004 may be used to stack two or more or the same materials together to make a composite material.

In FIG. 14A, special features of elements of the containers may enhance this usage. For example, airplane food containers need to be light-weight, durable, and reheatable or heatable. In addition, ovens or steamers on board a commercial airplane may be used to heat the meals. Also, the meal items may be with sauce, soup, or other liquids or fluids and some of these meal items are served warm or hot.

As such, with the mechanical properties illustrated above, the containers embodying elements of aspects of the invention also need to accommodate the packaging of the containers from the kitchen. Therefore, as shown in FIG. 14A, aspects of the invention may include a lid for the container and the lid is also made of the material illustrated in the present application. In addition, the lid and the container may include a locking mechanism that enable safe transportation of the containers and the meals. As shown in FIG. 14A, a tongue element in the container's outer edge at the end of its curved end may enter an opening created by an end of the lid. In this embodiment, the end of the lid may include a tip that may bend toward the container, thus creating the opening, instead of away from the container. The tip may include a sufficient length that pushes against the curved end of the container so as to allow the tongue element to engage the upper end of the opening of the lid. As the material having a tensile strength described above, the engagement of the tip and the curved end, as well as the tongue and the upper end of the lid is strong to keep the lid intact during transportation and heating/reheating.

In another embodiment, as shown in FIG. 14B, the tongue may be inserted to a tight opening by the end of the lid so it is a friction fit between the container and the lid.

In yet another embodiment, the outer surface of the lid and the bottom of the container may include complimentary features. For example, as shown in FIG. 14C, the meal containers need to be stackable. To prevent or alleviate slippage of the container from a lid underneath, the lid may include a lowered center portion or a recess with a contoured or concaved curved edge connecting the lowered center portion and the surface of the lid. Similarly, the footers of the container may be positioned inside the lowered center with each of the footers (e.g., 4) to engage four corners of the lowered portion and the contoured/concaved curved edge.

Moreover, the footers are protruding from the bottom of the container, as shown in FIG. 14D. In one embodiment, the footers are configured to create additional airflow by creating spaces between the container and the lid in a stacked position so that heat or steam may flow between the container and the lid. In one aspect, such feature further may maintain the wet tensile strength of the container.

Overall, aspects of the invention overcome shortcomings of the prior approaches where there are toxic chemicals (e.g., fluoropolymers and its derivatives) are added. Aspects of the invention also overcome the shortcomings of prior approaches of using pulps as the base layer or layers. It is to be understood that pulp fibers are in the 10 to 50 micrometer (μm) range for their diameters. Whereas aspects of the invention are finer in size, such as in the range of below 1 μm.

The above description is illustrative and is not restrictive. Many variations of embodiments may become apparent to those skilled in the art upon review of the disclosure. The scope embodiments should, therefore, be determined not with reference to the above description, but instead should be determined with reference to the pending claims along with their full scope or equivalents.

One or more features from any embodiment may be combined with one or more features of any other embodiment without departing from the scope embodiments. A recitation of "a", "an" or "the" is intended to mean "one or more" unless specifically indicated to the contrary. Recitation of "and/or" is intended to represent the most inclusive sense of the term unless specifically indicated to the contrary.

While the present disclosure may be embodied in many different forms, the drawings and discussion are presented with the understanding that the present disclosure is an exemplification of the principles of one or more inventions and is not intended to limit any one embodiments to the embodiments illustrated.

The present disclosure provides a solution to the long-felt need described above. In particular, aspects of the invention overcome challenges of relying on existing practices of using chemical formulas to provide enhanced properties for cellulose materials.

Further advantages and modifications of the above described system and method may readily occur to those skilled in the art.

The disclosure, in its broader aspects, is therefore not limited to the specific details, representative system and methods, and illustrative examples shown and described above. Various modifications and variations may be made to the above specification without departing from the scope or spirit of the present disclosure, and it is intended that the present disclosure covers all such modifications and variations provided they come within the scope of the following claims and their equivalents.

What is claimed is:

1. An apparatus for generating a biodegradable material comprising:

a first device for receiving a first material;

wherein the first device comprises a mesh for catching a portion of fibers in the first material;

a second device for engaging the portion of the fibers, wherein the second device comprises a container containing the first material;

a third device for engaging a second material with the portion of the fibers, the second material and the portion of the fibers form a third material; wherein the third device comprises another container;

a water removing device for reducing water content in the third material; wherein the water removing device comprises a vacuum or a heater; and wherein the first device, the second device, and third device form a vertical and/or horizontal system, wherein the first and second devices are configured to rotate a mold to be oriented upwards or downwards via an axis, wherein the third device further carries the second material to engage contents of the another container.

2. The apparatus of claim 1, further comprising a shaper comprises a mold for shaping the third material after the water removing device, wherein the shaper is configured to be connected to a heater or a vacuum to apply heat and pressure to the third material.

3. The apparatus of claim 1, wherein the first material comprise a pulp suspension.

4. The apparatus of claim 1, wherein the second material comprises a fibrillated cellulose slush after grinding.

5. The apparatus of claim 1, wherein the heating element is configured to maintain a temperature of the second material at least about 40 degrees Celsius.

6. The apparatus of claim 1, wherein the heating element is configured to warm a temperature of the second material at least about 40 degrees Celsius when the surface material engages the first material.

7. The apparatus of claim 1, wherein the third material is generally free from chemical additives adapted for improving tensile strength, enhanced oil barrier, gas and/or liquid impermeability, a tensile modulus, or a tensile index.

8. The apparatus of claim 1, wherein the third material comprises properties of:

an oxygen transmission rate of about 8000 $cm^3$ $m^2$ 24 $h^{-1}$ or less, a water vapor transmission rate of 3000 g $m^{-2}$ 24 $h^{-1}$ or less, a dry tensile strength of about 30 MPa or higher, a dry tensile modulus of about 4 GPa or higher, and a dry tensile index of about 45 Nm $g^{-1}$ or higher.

9. The apparatus of claim 1, wherein the third material comprises additional properties of:

a wet tensile strength of about 5 MPa or higher, a wet tensile modulus of about 0.4 MPa or higher, and a wet tensile index of about 5 Nm $g^{-1}$ or higher.

10. The apparatus of claim 1, wherein the third material comprises the fibrillated cellulose with a diameter of about 1-10000 nanometer (nm).

11. The apparatus of claim 1, wherein the third material comprises the fibrillated cellulose having about 0.1-1000 micrometers, about 10-500 micrometers, about 1-25 micrometers, or about 0.2-100 micrometers.

12. The apparatus of claim 1, wherein the third material comprises a planar sheet.

13. The apparatus of claim 1, wherein the third material comprises a container for edible items.

14. The apparatus of claim 1, wherein the third material comprises a fibrillated mixture.

15. The apparatus of claim 1, wherein the third material comprises a film with a thickness of about 0.01-3.0 millimeter (mm).

16. A system for generating a biodegradable material comprising:

a first device for receiving a first material, wherein the first device comprises a mesh for catching a portion of fibers in the first material;

a second device for engaging the portion of the fibers, wherein the second device comprises a container containing the first material;

a third device for engaging a second material with the portion of the fibers, the second material and the portion of the fibers form a third material; wherein the third device comprises another container;

a water removing device for reducing water content in the third material; wherein the water removing device comprises a vacuum or a heater; and a robotic arm and/or a track component for moving the first device, the second device, and third device vertically and/or horizontally, wherein the robotic arm is configured to rotate the first device to be oriented upwards or downwards via an axis, wherein the robotic arm is configured to move the first device or the second device to engage the second material in the third device.

* * * * *